US008640419B2

(12) United States Patent
Lee

(10) Patent No.: US 8,640,419 B2
(45) Date of Patent: Feb. 4, 2014

(54) METHOD OF CONSTRUCTING PREFABRICATED STEEL REINFORCED CONCRETE (PSRC) COLUMN USING ANGLE STEELS AND PSRC COLUMN USING ANGLE STEELS

(75) Inventor: Chang Nam Lee, Seoul (KR)

(73) Assignee: Senvex Co., Ltd., Seoul (KR)

( * ) Notice: Subject to any disclaimer, the term of this patent is extended or adjusted under 35 U.S.C. 154(b) by 0 days.

(21) Appl. No.: 13/396,051

(22) Filed: Feb. 14, 2012

(65) Prior Publication Data

US 2012/0210669 A1 Aug. 23, 2012

(30) Foreign Application Priority Data

Feb. 18, 2011 (KR) ..... 10-2011-0014502
Aug. 11, 2011 (KR) ..... 10-2011-0079994
Aug. 11, 2011 (KR) ..... 10-2011-0079995

(51) Int. Cl.
*E04H 12/00* (2006.01)

(52) U.S. Cl.
USPC ..... 52/649.2

(58) Field of Classification Search
USPC ..... 52/741.14, 742.1, 742.13, 742.14, 52/745.17, 745.21, 831, 834, 836, 843, 52/648.1, 649.1, 649.2, 633
See application file for complete search history.

(56) References Cited

U.S. PATENT DOCUMENTS

| | | | | | |
|---|---|---|---|---|---|
| 966,274 | A * | 8/1910 | Wainwright et al. | 52/254 |
| 1,033,797 | A * | 7/1912 | Hartman | 52/252 |
| 3,867,805 | A * | 2/1975 | Mikami et al. | 52/742.15 |
| 4,604,250 | A * | 8/1986 | Ecker | 264/35 |
| 4,938,635 | A * | 7/1990 | Russell | 405/252 |
| 5,367,854 | A * | 11/1994 | Kim | 52/745.13 |
| 8,161,707 | B2 * | 4/2012 | Simmons | 52/648.1 |
| 2002/0000070 | A1 * | 1/2002 | VeRost et al. | 52/295 |
| 2002/0035813 | A1 * | 3/2002 | Triebel | 52/633 |
| 2005/0016111 | A1 * | 1/2005 | Knepp et al. | 52/633 |
| 2006/0117704 | A1 * | 6/2006 | Yoon et al. | 52/737.4 |
| 2006/0236647 | A1 * | 10/2006 | Fehr et al. | 52/720.1 |
| 2006/0265992 | A1 * | 11/2006 | Hiragaki | 52/633 |
| 2008/0098676 | A1 * | 5/2008 | Hutchens | 52/281 |

FOREIGN PATENT DOCUMENTS

| | | |
|---|---|---|
| KR | 10-0631365 B1 | 9/2006 |
| KR | 10-0648376 B1 | 11/2006 |
| KR | 10-1050956 B1 | 7/2011 |

* cited by examiner

*Primary Examiner* — Mark Wendell
*Assistant Examiner* — Keith Minter
(74) *Attorney, Agent, or Firm* — Ladas & Parry LLP

(57) ABSTRACT

A steel reinforced concrete (PSRC) column is prefabricated with angle steels at the corners. The column has auxiliary reinforcement bars between the angle steels and tie bars surround the angle steels and auxiliary reinforcement bars. Column capital steel plates are fixed to the structure, outside the angle steels and the auxiliary reinforcement bars. Column capital reinforcing steel plates are diagonally attached inside the PSRC column. A mold is used to fill the column with cement.

6 Claims, 29 Drawing Sheets

METHOD OF CONSTRUCTING PREFABRICATED STEEL REINFORCED CONCRETE (PSRC) COLUMN USING ANGLE STEELS AND PSRC COLUMN USING ANGLE STEELS

CROSS-REFERENCE TO RELATED PATENT APPLICATIONS

This application claims the benefit of Korean Patent Application No. 10-2011-0014502, filed on Feb. 18, 2011, Korean Patent Application No. 10-2011-0079994, filed on Aug. 11, 2011, and Korean Patent Application No. 10-2011-0079995, filed on Aug. 11, 2011, in the Korean Intellectual Property Office, the disclosures of which are incorporated herein in their entirety by reference.

BACKGROUND OF THE INVENTION

1. Field of the Invention

The present invention relates to a prefabricated steel reinforced concrete (PSRC) column, and more particularly, to a PSRC column having angle steels.

2. Description of the Related Art

As shown in FIG. 1A, a conventional steel reinforced concrete (SRC) column or beam for use in construction is formed by surrounding a steel framed column 21, such as an H-shaped or wide flange steel column, with reinforced concrete 22. A mold 23 is used to cast the concrete 22 around the steel framed column 21 and tie bars 13.

FIG. 1B shows a panel zone having girders 41 projecting in four directions from a column. Although the panel zone is structurally important, molding the panel zone has been carelessly managed in many cases. Manufacturing/constructing the panel zone is expensive and typically consumes a lot of time.

SUMMARY OF THE INVENTION

The present invention is directed at a method of constructing a prefabricated steel reinforced concrete (PSRC) column using angle steels and a PSRC column having angle steels. In an embodiment, the angle steels may be used as vertical materials while reinforcement bars (REBAR) may be used as horizontal or inclined materials. The PSRC column may have a reduced mold area in comparison to conventional PSRC columns. A further advantage may be a simplified panel zone mold, which have previously been complicated to manufacture on-site. A PSRC column constructed having angle steels may also lessen vertical error.

According to an aspect of the present invention, there is provided a method of constructing a PSRC column by fabricating angle steels and reinforcement bars, the method including: erecting angle steels on corners of the PSRC column having a quadrangular cross-sectional shape; adding auxiliary reinforcement bars between the angle steels; surrounding the angle steels and the auxiliary reinforcement bars with tie bars that are horizontally arranged at defined intervals; welding and fixing the tie bars to the structure; welding column capital steel plates outside the angle steels and the auxiliary reinforcement bars where the beams are provided; and/or diagonally attaching column capital reinforcing steel plates at positions where the beams are provided to inner surfaces of the column capital steel plates; attaching the beams or brackets outside the column capital steel plates to manufacture the PSRC column and/or carry and erect the PSRC column on-site. Remaining central portions of the beams may be attached to the brackets, a mold may be provided around the PSRC column, and concrete may be cast into the mold.

The method may further include: forming bolt holes for attaching short angle steels of which height is corresponding to that of the beams or brackets and may be lightweight, to side surfaces of the beams or brackets, which are spaced by a distance corresponding to a covering depth, in end portions of the beams or brackets attached to the PSRC column, and attaching the short angle steels to the side surfaces of the beams or brackets with bolts, and fixing end portions of angle lightweight pre-formed steel plates used as permanent molds to the short angle steels with self-drilling screws.

According to another aspect of the present invention, there is provided an earthquake-resistant method of joining, in a prefabricated steel reinforced concrete (PSRC) column, angle steels to steel beams by placing and fixing +-shaped rigid beams at a center of the PSRC column in a panel zone of the PSRC column, the earthquake-resistant joining method including: horizontally welding beam saddles between four angle steel pairs arranged with a free space of 10 to 50 mm or more, which is larger than a width of each beam, at left and right sides of four beams that constitute the +-shaped rigid beams from among the angle steels; making cross-sectional shapes of the beam saddles as one of a ⊓-shape, T-shape, or Π-shape, and making top surfaces of the beam saddles match the heights of lower ends of lower flanges of the +-shaped rigid beams; joining the PSRC column with the beams by bolting or welding the beam saddles to the lower flanges of the +-shaped rigid beams; providing a mold around the PSRC column; and casting concrete into the mold.

Further, if the widths of the beams are too large and there is not enough free space to pour concrete into the PSRC column, column members may be cut and continuously welded to top and bottom surfaces of upper and lower flanges of the beams, and short members such as the cut column members may be inserted and welded between the upper and lower flanges of the beams.

According to another aspect of the present invention, there is provided a gang forming method of a prefabricated steel reinforced concrete (PSRC) column, the method including: fixedly attaching steel strands to both lower portions of steel beams or brackets placed and fixed on a top end of a PSRC column; downwardly hanging the steel strands; coupling hollow climbing hydraulic jacks to lower ends of the steel strands; attaching the hollow climbing hydraulic jacks to yokes of a mold, manufactured to have a height which is about ½ to ¼ of a height of the PSRC column, by using a jig; and connecting the hollow climbing hydraulic jacks to hydraulic pumps with a hydraulic hose. After a minimum time taken for a pre-cast lower portion of concrete to be self-supported without the mold passes, pushing the mold upward by using, for example, the hydraulic jacks, and sequentially casting an upper portion of the concrete over the pre-cast lower portion.

Lengths of joists may be automatically reduced by making an interval between the yokes at a lower portion of the mold, where lateral pressure of the concrete is high, lower than an interval between the yokes at an upper portion of the mold, where lateral pressure of the concrete is low, thereby improving the effect of the yokes and the joists.

In order to dismantle two yokes having H-shapes that meet each other at a right angle, two outskirt bolt holes and one central bolt hole may be formed in an end portion of one yoke; two outskirt bolt holes may be formed in an end portion of the remaining yoke, and the end portions may be reinforced with stiffeners to obtain joint steel plates; the joint steel plates may be welded to the end portions of the yokes at 45° and joint bolts may be inserted into the outskirt bolt holes of the bolt holes of the joint steel plates that face each other; and a coupler may be welded to an outer surface of the central bolt hole, wherein, to separate the mold from the concrete, the joint bolts are unfastened, separation bolts are inserted into the coupler and turned clockwise so that the separation bolts push surfaces of the joint steel plates with no bolt hole and create a force for widening an interval between the joint steel plates that face each other, thereby separating the mold from a surface of the concrete.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1A:
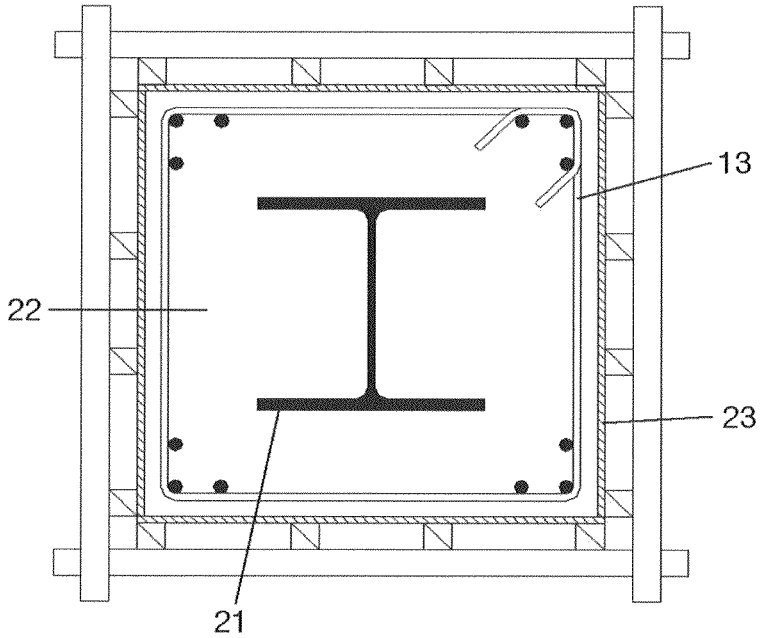
FIG. 1A (PRIOR ART)
FIGS. 1A and 1B illustrate a conventional steel reinforced concrete (SRC) column and beams.
Figure 1B:
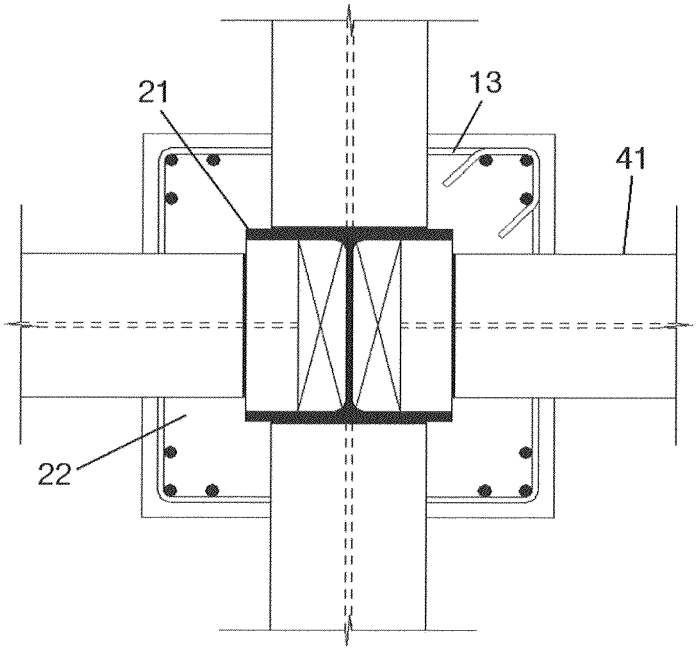
FIG. 1B (PRIOR ART)

The present invention will now be described more fully with reference to the accompanying drawings, in which exemplary embodiments of the invention are shown. In the drawings, elements denoted by the same reference numerals are substantially the same elements.

Although the applicant has developed a technology for a column including angle steels, since the demand and supply of angle steel materials are not well balanced, it is difficult to actually use the technology. In order to solve this problem, the applicant has developed a prefabricated reinforced concrete (PRC) column using large diameter high strength welded reinforcement bars instead of angle steels, and used the PRC column for numerous buildings to improve a construction method. The applicant suggests a method of constructing a PSRC column using angle steels and reinforcement bars based on the PRC column.

In general, an RC structure exhibits resistance by providing reinforcement bars having a high tensile resistance at a tensile portion of concrete which has a high compressive resistance. However, the RC structure has problems in that a mold and a support for containing flowing concrete need to be manufactured, mold release costs are required, and a standard curing time of concrete is 28 days which is difficult to reduce.

Figure 2A:
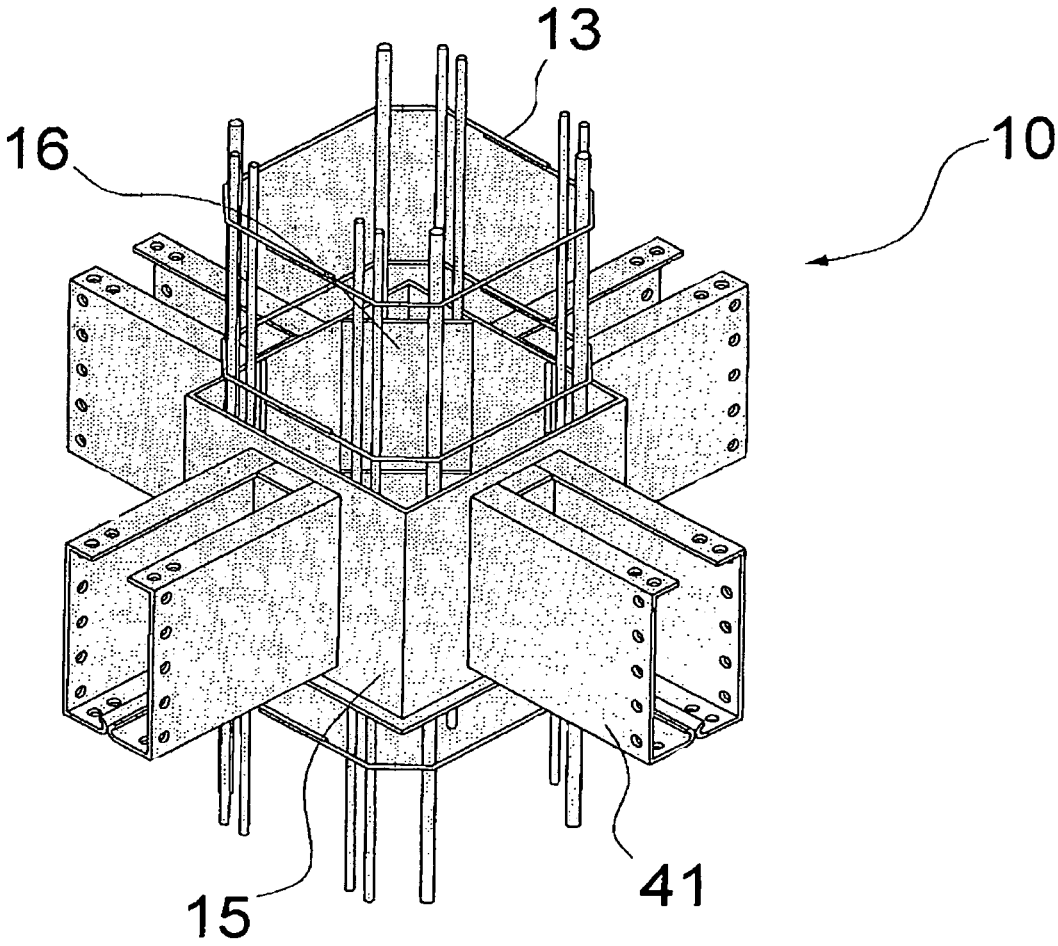
FIG. 2A (PRIOR ART)
FIG. 2A illustrates a panel zone of a prefabricated reinforced column.
Figure 2B:
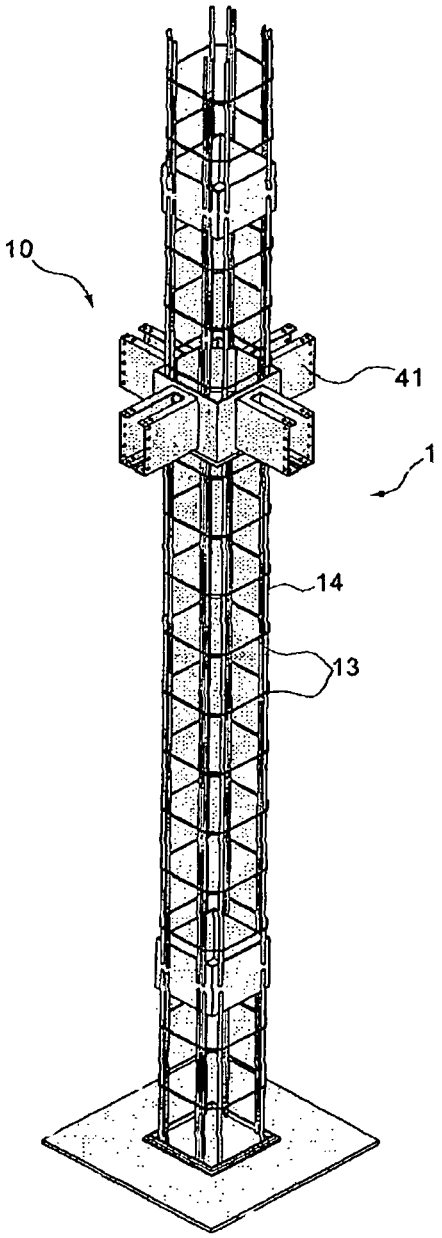
FIG. 2B (PRIOR ART)
FIG. 2B illustrates the prefabricated reinforced column of FIG. 2A.

In order to solve these problems, reinforcement bars have recently been prefabricated in a steel fabrication shop such that the reinforcement bars may be self-supported during construction, thereby minimizing a mold stripping time, drastically reducing manufacturing costs, and reducing an operation of processing and fabricating the reinforcement bars on-site. Such a prefabricated reinforced column is shown in FIGS. 2A and 2B. FIG. 2B illustrates the prefabricated reinforced column 1 and FIG. 2A illustrates a panel zone 10 of a prefabricated reinforced column 1. The prefabricated reinforced column 1 includes column main bars 14, tie bars 13, girders 41, and a panel zone 10. The panel zone 10 includes column capital steel plates 15 and column capital reinforcing steel plates 16.

In the current specification, since a horizontal structural element which is connected directly to a column is referred to as a girder in this technical field, the elements corresponding to element numeral 41 are referred to as girders. However, in the current specification, an element which is referred to as a beam may be a girder in a strict sense. This is due to the fact that a beam is a horizontal structural element which supports a vertical load by definition and a girder, therefore, may be regarded as a kind of a beam in this sense.

Angle steels may be used as the structure and support material for constructing lightweight roof trusses, telegraph poles, pylons, supports, handrails for tower cranes, stairs, trenches and other types of construction work. Angle steels are typically exposed to the outdoor elements. Angle steels larger than 100×100 mm have not been commonly available in the market. In particular, due to manufacturing costs and lead times, angle steels made with high strength steel for structural use are expensive and available only through very large volume order. Also, large angle steels are generally bound to a longer lead time, which is usually two or three months, than other steel products such as reinforcement bars or I-beams.

Figure 3A:
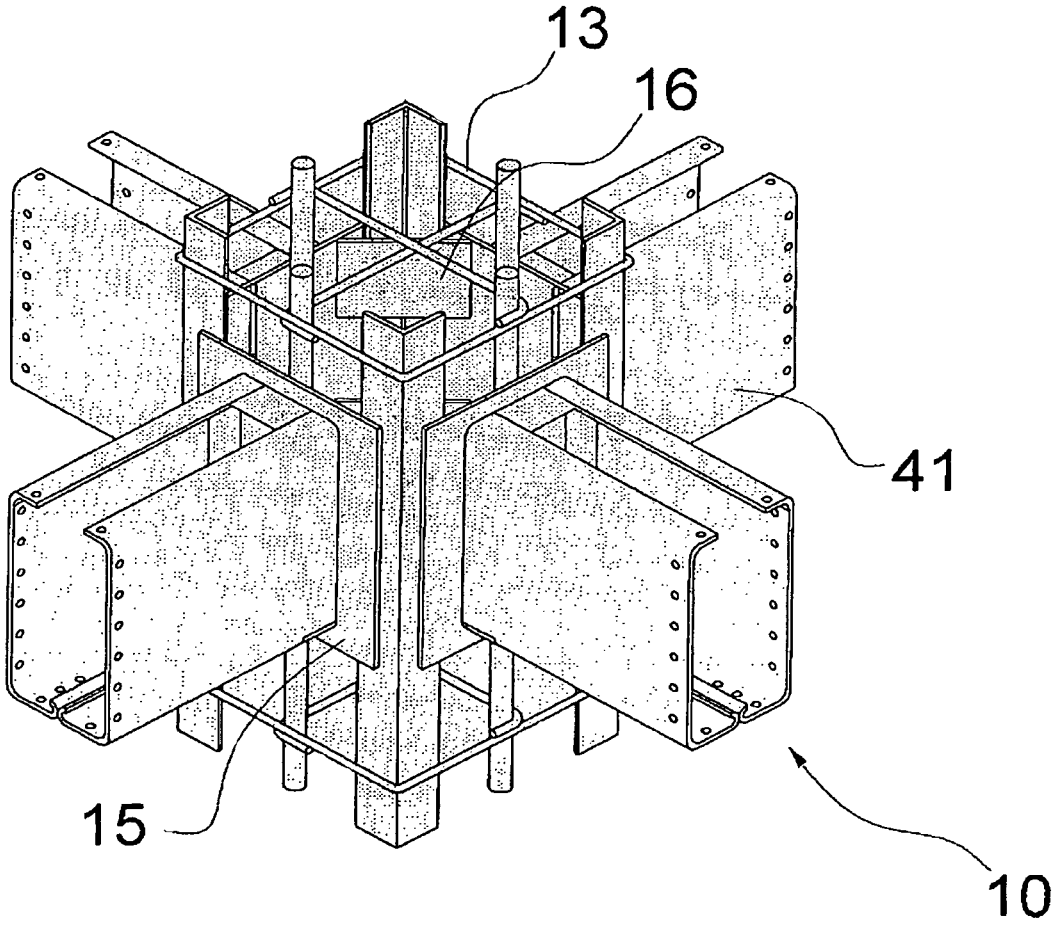
FIG. 3A illustrates a panel zone of a prefabricated steel reinforced concrete (PSRC) column.
Figure 3B:
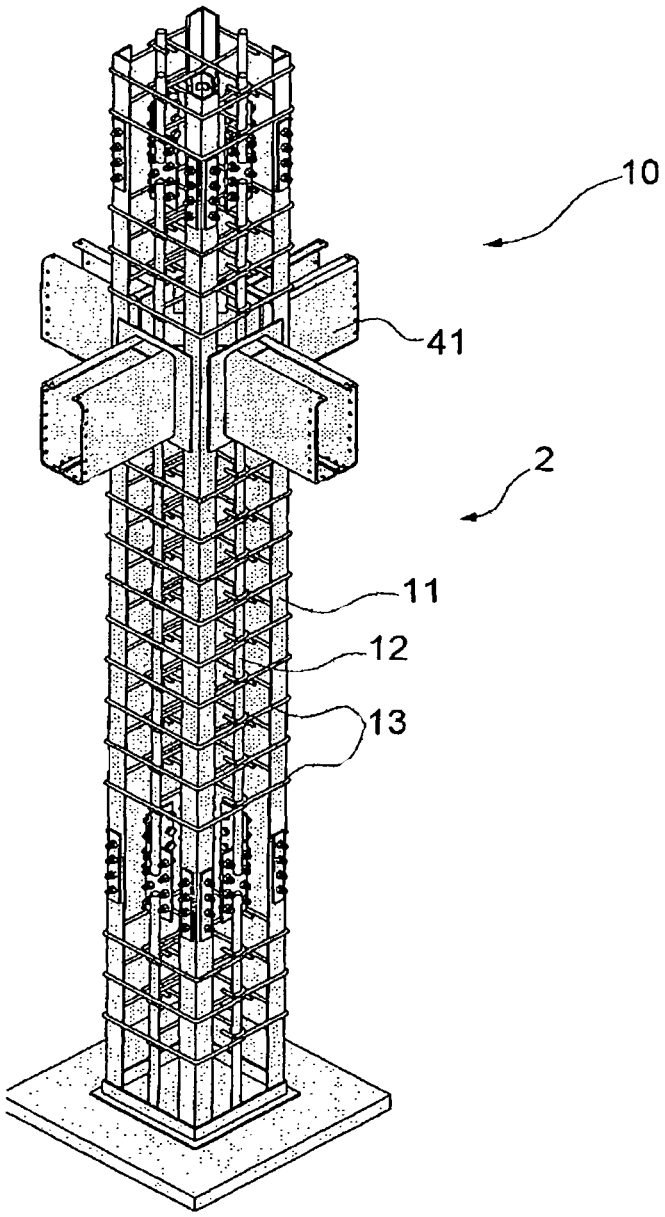
FIG. 3B illustrates the PSRC column of FIG. 3A.

A PSRC column having angle steels is shown in FIGS. 3A and 3B. FIG. 3B illustrates the PSRC column 2, and FIG. 3A illustrates a panel zone 10 of a PSRC column 2. Referring to FIGS. 3A and 3B, angle steels 11 are disposed at edges of the PSRC column 2. Also, both sides of column capital steel plates 15' are coupled to the angle steels 11 in the panel zone 10. Also, auxiliary reinforcement bars 12 are disposed between and parallel to the angle steels 11.

When the PSRC column 2 is designed by using an SRC structural calculation standard instead of an RC structural calculation standard, an economic effect due to a difference in design standard may also be achieved. While reinforcement bars are manufactured by melting scrap iron, angle steels are manufactured by performing hot rolling on first-made iron produced in a blast furnace. Accordingly, since the reliability of the angle steels is higher than that of the reinforcement bars, the PSRC column 2 using the angle steels exhibits improved characteristics. Results obtained by performing tests on reinforcement bars manufactured by steelmakers show that there is a large error in an elongation ratio. The error affects earthquake resistance, as shown in Table 1. The reliability of SN materials is much higher.

TABLE 1

Results of Tension Test Performed on Reinforcement Bars: SD500W

| | Name | Heat treatment | Results of Test: Yield strength (MPa) | Tensile strength (MPa) | Elongation ratio (%) |
|---|---|---|---|---|---|
| 01 | 41-N-L-12 | none | 561.2 | 669.0 | 9.5 |
| 02 | 41-N-M-13 | none | 537.3 | 660.1 | 16.9 |
| 03 | 41-N-S-13 | none | 550.7 | 667.9 | 13.4 |
| 04 | 41-P-L-12 | preheating | 552.2 | 670.1 | 13.9 |
| 05 | 41-P-M-13 | preheating | 549.1 | 671.6 | 16.7 |
| 06 | 41-P-S-13 | preheating | 538.5 | 660.8 | 15.5 |
| 07 | 41-A-M-13 | postheating | 560.4 | 676.4 | 16.2 |
| 08 | 41-A-L-12 | postheating | 565.0 | 690.3 | 13.3 |
| 09 | 29-N-L-12 | none | 539.2 | 675.6 | 15.2 |
| 10 | 29-N-M-10 | none | 549.5 | 676.4 | 12.7 |
| 11 | 29-N-S-10 | none | 538.6 | 670.9 | 15.5 |
| 12 | 29-N | none | 543.3 | 672.5 | 16.9 |

Note:
the name field designates the test number and the diameter of the reinforcement bar-heat treatment method-amount of welding-diameter of reinforcement bar at welded portion; heat treatment method key - (N: none, P: preheating, A: postheating).

A KS standard is shown as in Table 2.

TABLE 2

KS Standard

| Type | Yield strength (MPa) | Tensile strength (MPa) | Elongation ratio (%) |
|---|---|---|---|
| SD500W | 500 or more | 620 or more | 14 or more |

Conventional prefabricated reinforced structures include concentrated thick reinforcement bars on corners of a beam and a column in order to maximize advantages. Since angle steels achieve the same effect as that obtained when reinforcement bars are concentrated on corners because of the cross-sectional shape of the angle steels, the advantages of prefabricated reinforced structures are automatically achieved. Also, welding of tie bars, the number of welded places, and the amount of welding may be reduced.

Figure 4A:
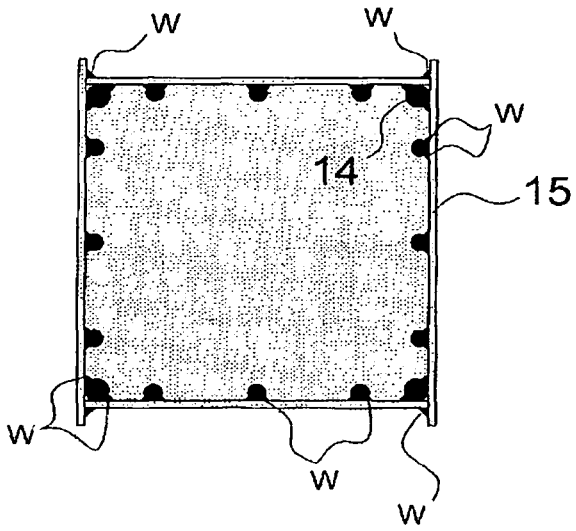
FIG. 4A (PRIOR ART)
FIGS. 4A through 4D illustrate welded portions of a panel zone and a tie bar in a prefabricated reinforced concrete (PRC) column and a PSRC column.
Figure 4B:
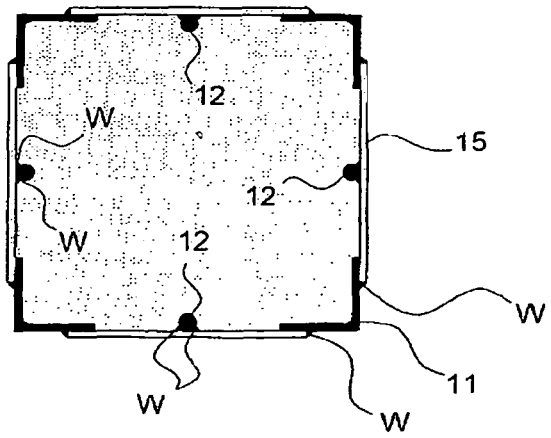
Figure 4C:
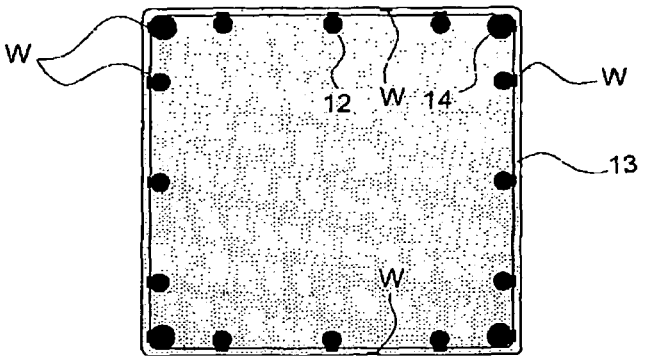
FIG. 4C (PRIOR ART)
Figure 4D:
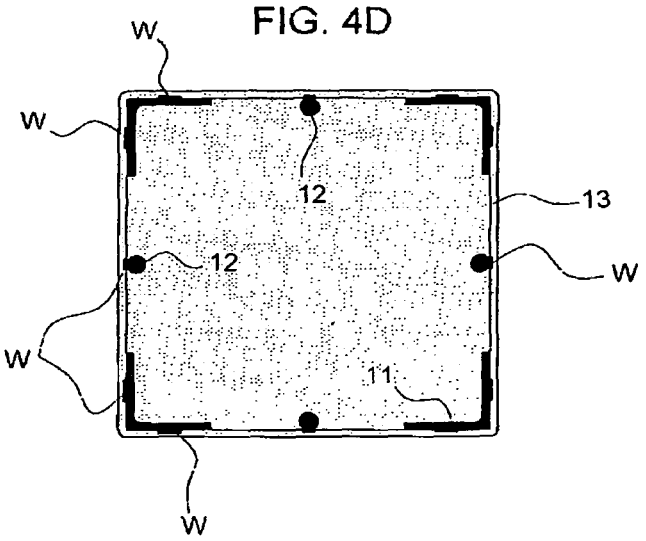

FIGS. 4A through 4D illustrate welded portions W of a panel zone and a tie bar in a PRC column and a PSRC column. FIGS. 4A and 4B illustrate the welded portions W of the panel zone in the PRC column and the PSRC column. FIGS. 4C and 4D illustrate the welded portions W of the tie bar in the PRC column and the PSRC column. Referring to FIG. 4A, the panel zone of the PRC column has 36 welded portions W. Referring to FIG. 4B, the panel zone of the PSRC column has 16 welded portions W. Referring to FIG. 4C, the tie bar of the PRC column has 18 welded portions W. As drawn in FIG. 4C, the tie bars 13 are also welded to each other Referring to FIG. 4D, the tie bar of the PSRC column has 12 welded portions W. That is, it is found from FIGS. 4A through 4D that the number of welded portions W of the PSRC column may be much less than the number of welded portions W of the PRC column.

Figure 5A:
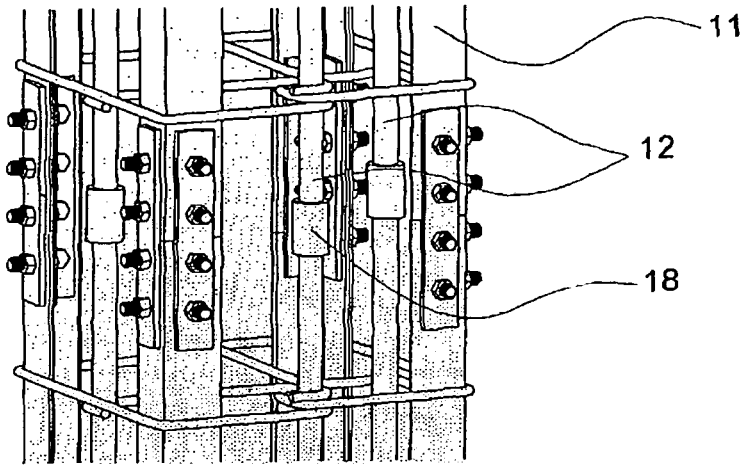
FIGS. 5A through 5C illustrate a bolt joint portion of PSRC column, a welding joint portion of a PSRC column, and a joint portion of a PRC column.
Figure 5B:
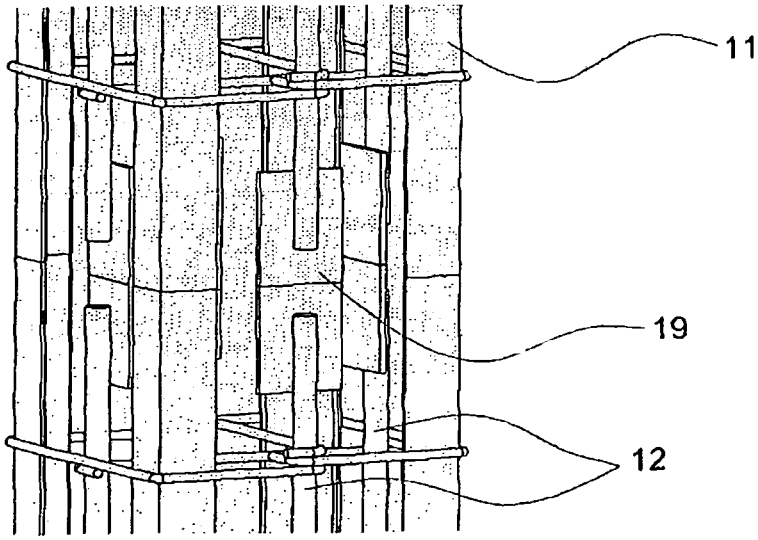
Figure 5C:
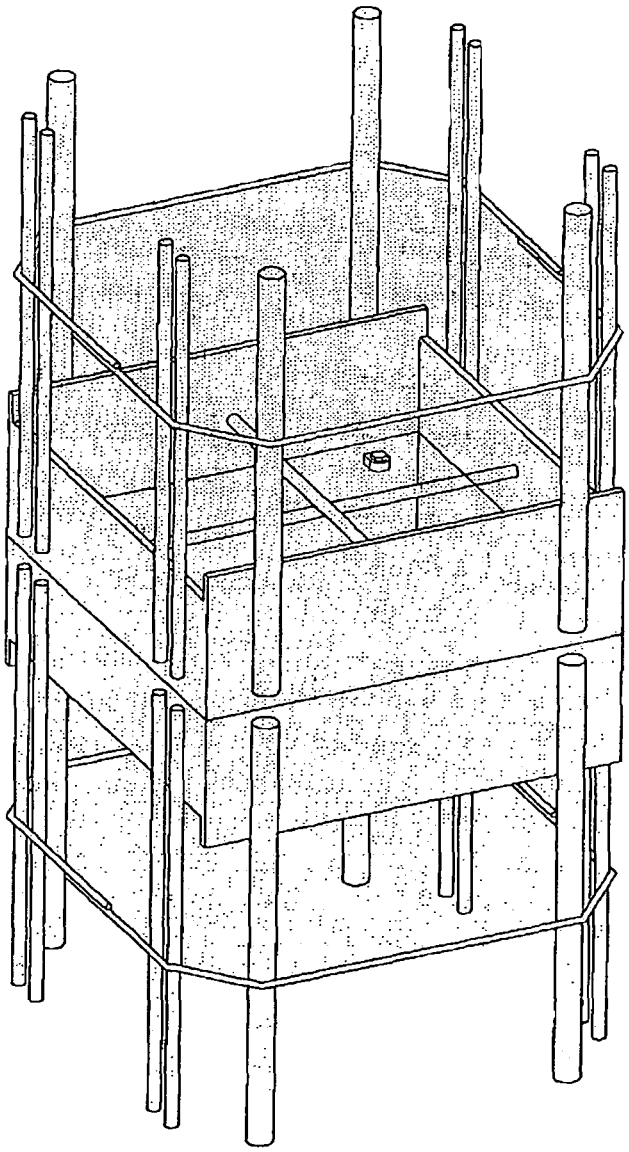
FIG. 5C (PRIOR ART)

FIGS. 5A through 5C illustrate a bolt joint portion of a PSRC column, a welding joint portion of a PSRC column, and a joint portion of a PRC column, respectively. Referring to FIG. 5B, although joint steel plates are not additionally used to join a column and beams, since the angle steels 11 are directly welded to each other, additional steel materials and the amount of welding may be reduced.

When the angle steels 11 are used, the angle steels 11 may be directly welded to each other on-site or bolted to each other to link upper and lower columns, as compared to a PRC column. That is, as shown in FIG. 5A, upper and lower columns may be connected to each other by using a coupler 18 or an auxiliary reinforced bar joining steel plate 19, as shown in FIG. 5B.

Since each of the angle steels 11 has a larger radius of gyration than that of each of the reinforcement bars shown in Table 3, the buckling length bending stiffness are both high.

TABLE 3

Comparison in Radius of Gyration between Reinforcement Bars and Angle Steels

| Reinforcement bar: Standard | Cross-sectional area (mm) | Radius of gyration (mm) | Angle steel: Standard | Cross-sectional area (mm) | Radius of gyration (mm) |
|---|---|---|---|---|---|
| D38 | 1140 | 9.5 | 90 × 90 × 6 | 1055 | 27.7 |
| D41 | 1340 | 10.2 | 100 × 100 × 7 | 1362 | 30.8 |
| D51 | 2027 | 12.8 | 100 × 100 × 10 | 1900 | 30.4 |

Accordingly, the strength of PSRC materials is greater, the structural stability of the PSRC materials while being carried and fabricated on-site is greater, and straightness is greater.

According to the Korean Building Code, a designed compressive strength of an RC column is as follows.

In the case of an RC column using a tie bar:

$$\phi P_n=0.65(0.8P_o)=0.65\times0.8\times[f_yA_{st}+0.85f_{ck}A_c] \quad (1)$$

where

ϕ is a strength reduction factor,

Pn is a nominal strength when there is eccentricity,

Po is a nominal strength when there is no eccentricity,

Fy is a design standard yield strength of a tensile reinforcement bar,

Fck is a design specified compressive strength of concrete,

Ast is a cross-sectional area of a reinforcement bar, and

Ac is a cross-sectional area of concrete.

In the case of an RC column using spiral reinforcement bars:

$$\phi P_n=0.70(0.85P_o)=0.70\times0.85\times[f_yA_{st}+0.85f_{ck}A_c].$$

A designed compressive strength of an SRC column is as follows.

In the case of $P_e \geq 0.44P_a$:

$$\phi P_n=0.75\times P_o[0.658^{(P_0/P_a)}] \quad (2)$$

where $P_o=A_sF_y+A_yF_y+0.85A_cf_{ck}$, and $P_e=\pi^2(EI_{eff})/(KL)^2$, where E is an elastic modulus, EIeff is an effective bending stiffness of a compressive member, K is an effective buckling length coefficient, and L is a column length.

In the case of $P_e(0.44P_a$, where $\phi P_n=0.75\times0.877P_e$.

Figure 6:
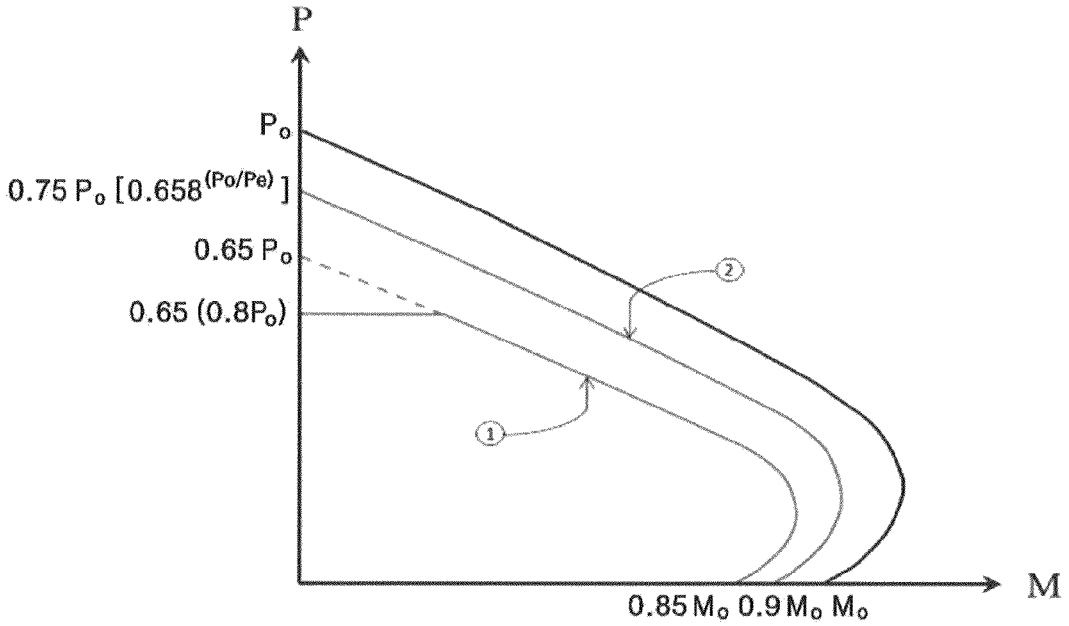
FIG. 6 illustrates a column-strength (P-M) diagram.

A structure design standard using the designed compressive strengths of the RC column and the SRC column may be shown as a column-strength (P-M) diagram in FIG. 6.

When efficiency is calculated by considering buckling of an SRC composite column according to design standards, for example the newly established Korean building code (KBC) 2009, although there are other variables, the efficiency of angle steels used in an SRC column is higher by about 30 to 40% than reinforcement bars used in an RC column. Accordingly, even considering the fact that angle steels such as SN490 are more expensive by about 5% than large diameter high strength reinforcement bars, the angle steels are better by 25 to 35% than the large diameter high strength reinforcement bars.

Considering that most new technologies and construction methods are better by about 10% than conventional construction methods, the effect of the present invention is considerable. Costs per unit for calculating mold manufacturing costs are based on surface area. Hence, parts which a carpenter who does mold works feels most difficult to construct are stairs, a column, and a panel zone to which beams are attached. Also, the vertical error generated in a PSRC column in construction conditions needs to be corrected with a mold.

There is a difference in RC and SRC design standards. When angle steels are considered as reinforcement bars and designed according to an RC structure standard, large resistance does not occur but an economic effect is reduced. On the other hand, when reinforcement bars instead of steel materials such as angle steels are used as inclined materials, considered as steel materials, and designed according to an SRC structure standard, an economic effect of about 25 to 35% is obtained. However, when the above unfamiliar type and steel materials are used actually, some resistance is expected to occur. In order to solve this problem, when an SRC structure is designed by using angle steels for both horizontal materials and inclined materials of a column, there may be a mismatch with an interval between RC tie bars. Accordingly, research materials that are convincing through experiments need to be provided. This is because most construction engineers think that an SRC structure is an RC structure obtained by disposing H-shaped steels at a center, as shown in FIG. 1A.

Hence, the present invention uses angle steels for vertical materials and reinforcement bars for horizontal materials or inclined materials. Also, the present invention provides a mold having a small area and simplifies a mold for a panel zone which is difficult to be manufactured on-site. In addition, the present invention reduces the burden of correcting a vertical error of a PSRC column with a mold.

As shown in FIG. 3A, the angle steels 11 and the auxiliary reinforcement bars 12 are additionally disposed at edges of the PSRC column having a quadrangular cross-sectional shape by considering a concrete covering depth, tie bars 13 are horizontally wound around the vertical materials, and welded to the angle steels 11 and the auxiliary reinforcement bars 12. An operation of welding the tie bars 13 to the angle steels 11 and the auxiliary reinforcement bars 12 may be performed on-site, or may be performed in factory.

A structure design standard is based on an SRC design standard of the KBC 2009 which has been recently published, and the thicknesses and maximum intervals of the tie bars 13 are determined not to violate an RC structure design standard as well.

A prefabricated column may be manufactured by manufacturing one unit as high as 2 or more stories at one time. The prefabricated column may be more economically designed by adjusting the number of auxiliary reinforcement bars 12 according to upper and lower stress applied to the prefabricated column. In the case of a prefabricated column having one unit as high as 3 stories, the auxiliary reinforcement bars 12 may be concentrated on lower stories, which is economically preferable.

Figure 7A:
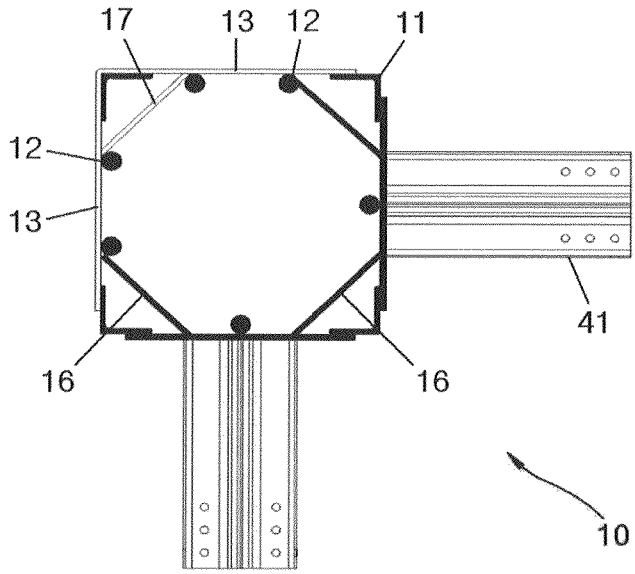
FIGS. 7A through 7C illustrate the panel zone of the PSRC column.
Figure 7B:
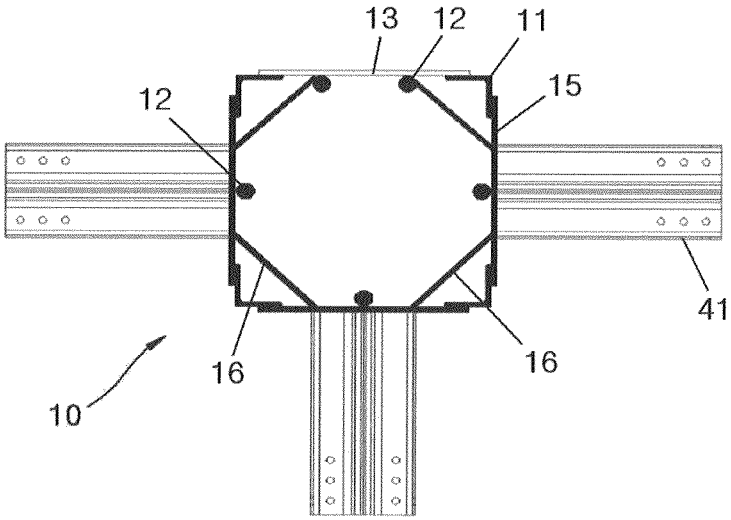
Figure 7C:
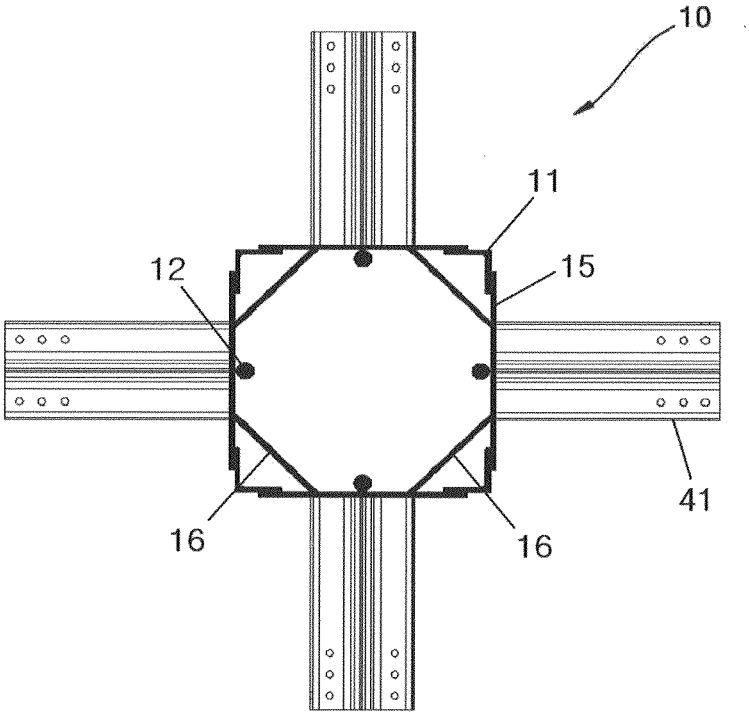

FIGS. 7A through 7C illustrate the panel zone 10 of the PSRC column. FIGS. 7A through 7C illustrate a case where beams are joined in 2, 3, and 4 directions to the panel zone 10 of the PSRC column. Referring to FIGS. 7A through 7C, the column capital steel plates 15 to which the girder 41 is attached are welded to vertical materials in the panel zone 10 where the girder 41 are joined to the PSRC column including the angle steels 11, the auxiliary reinforcement bars 12, and the tie bars 13. The column capital reinforcing steel plates 16 are additionally welded to inner surfaces of the column capital steel plates 15 in order to transmit stress of the girder 41 to opposite beams.

The girder 41 or brackets are welded in two, three, or four directions to outer surfaces of the column capital steel plates 15 in the panel zone 10, the angle steels 11 are welded or bolted on-site to each other at joints of units of the PSRC column, and the auxiliary reinforcement bars 12 are joined with each other by using a steel plate or a coupler.

Like a PRC column, the PSRC column is completed by attaching the girder 41 to the panel zone 10, providing a mold outside the angle steels 11 and the tie bars 13, and pouring concrete into the mold.

Referring again to FIGS. 7A through 7C, only the column capital steel plates 15 are attached to surfaces to which the girder 41 are attached. In this case, the auxiliary reinforcement bars 12 to which the column capital reinforcing steel plates 16 are attached may be added to surfaces to which girders 41 are not attached in the panel zone 10.

Figure 8:
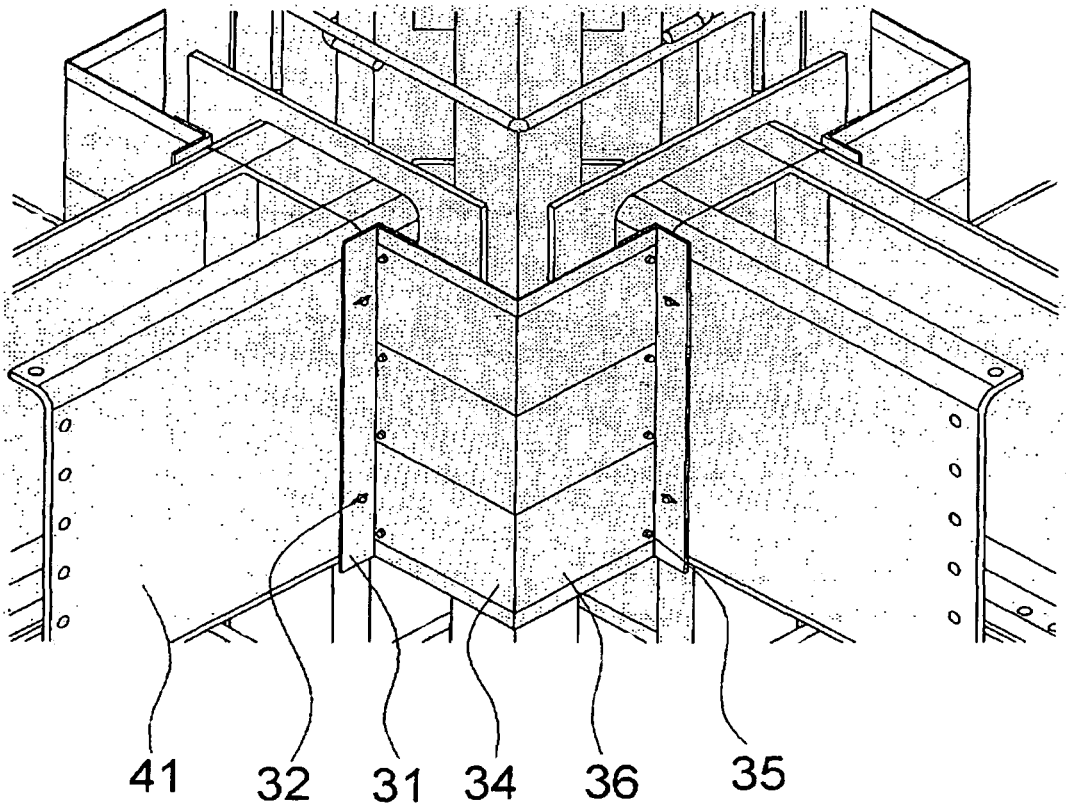
FIG. 8 illustrates the panel zone portion.

FIG. 8 illustrates the panel zone 10. Referring to FIG. 8, bolt holes are formed in side surfaces of the girder 41 or the brackets, and the girder 41 or the brackets passing through slot holes are coupled to lightweight angle steels 31 with bolts 32. The lightweight angle steels 31 coupled to the girder 41 are coupled to angle lightweight pre-formed steel plates 34, and reinforcing ribs 36 may be formed on the angle lightweight pre-formed steel plates 34 in order to increase strength. The angle lightweight pre-formed steel plates 34 may function as permanent molds, and self-drilling screws 35 may be coupled to the angle lightweight pre-formed steel plates 34.

A PSRC column and a method of providing beams in a panel zone of the PSRC column, according to another embodiment of the present invention, will be explained.

A method of rigidly connecting steel beams to a steel reinforced concrete column comprises rigidly connecting steel beams to a steel framed column like in a steel frame structure. That is, steel reinforced concrete is obtained by surrounding a steel framed column with reinforced concrete.

The reason why a steel framed column is surrounded by reinforced concrete is that construction costs may be lower than those when a column is designed with only steels, and fire resistance, which a steel framed column does not have, is automatically achieved.

Since, in a PSRC column, there is no steel framed column at the center of the column, to which steel beams are to be rigidly connected unlike a general steel reinforced concrete column, a separate earthquake-resistant joining method is preferred.

A steel reinforced concrete column has the advantage of achieving fire resistance, and another advantage in that a cross-sectional area of a central portion of a steel framed column is reduced because part of an axial force borne by the column is also borne by concrete, which has excellent compressive resistance for its price. However, a typical steel reinforced concrete column is against the basic principles of structural mechanics, one of which is that materials having excellent compressive resistance shall be disposed at a central portion and materials having excellent tensile resistance shall be disposed at outskirt portions.

For example, although reinforcement bars may be designed to be provided at any portion of a reinforced concrete column, a designer does not provide the reinforcement bars at a central portion of the reinforced concrete column.

Due to the aforesaid problems, in an earthquake-resistant design in which a column bears not only a compressive force but also a bending moment, a typical steel reinforced concrete column may be a very unpractical column. In order to dispose materials according to characteristics of the materials, methods of directly joining steel beams to a reinforced concrete column having better efficiency than a steel reinforced concrete column have been studied.

Figure 9A:
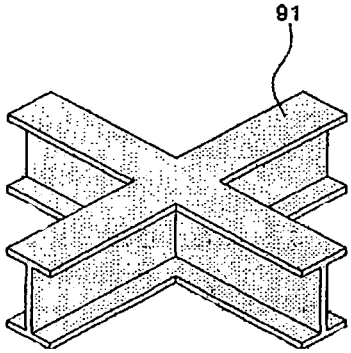
FIGS. 9A through 9F are views for explaining a logical composite (LC) frame method.
Figure 9B:
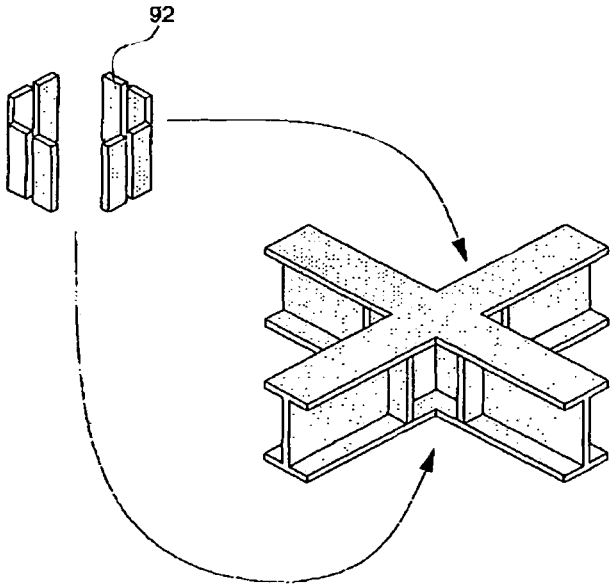
Figure 9C:
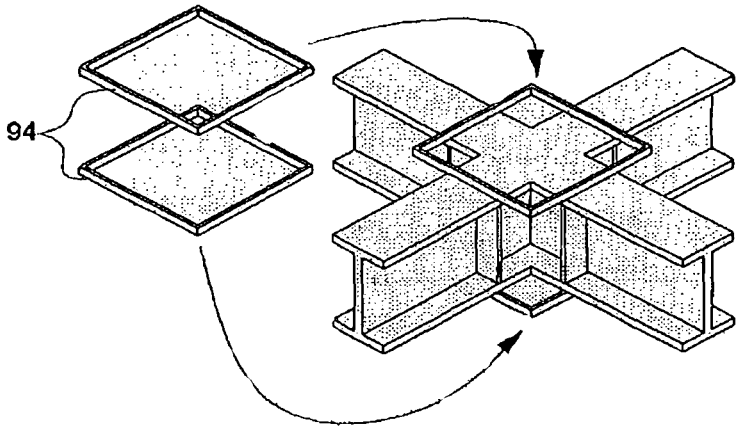
Figure 9D:
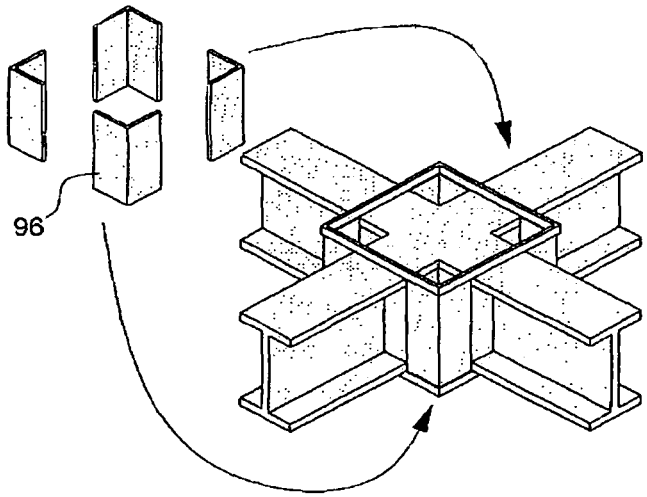
Figure 9E:
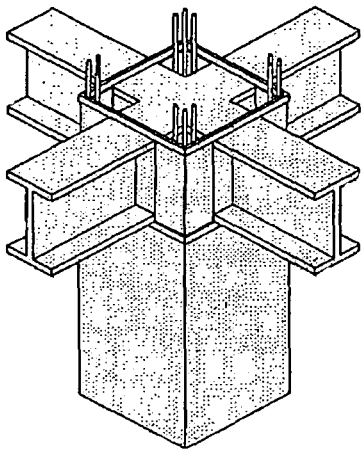
Figure 9F:
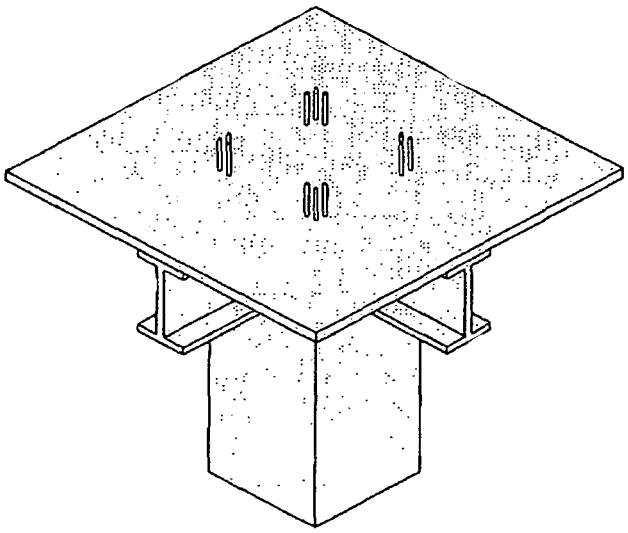

One of the methods is a logical composite (LC) frame method. FIGS. 9A through 9F are views for explaining an LC frame method. FIG. 9A illustrates basic steel frames 91. FIG. 9B illustrates a face bearing plate (FBP) 92. FIG. 9C illustrates upper and lower band plates 94. FIG. 9D illustrates a cover plate 96. FIG. 9E illustrates a case where a reinforced concrete column and steel beams are fabricated on-site. FIG. 9F illustrates a case where a slab is constructed.

Figure 10A:
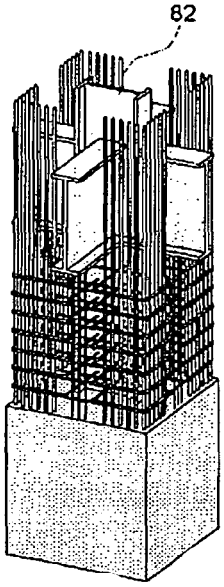
FIGS. 10A through 10B illustrate steel materials arranged by using the LC frame method when there is little space where column concrete is to be cast because a cross-sectional area of a column is small and widths of +-shaped rigid beams are large.
Figure 10B:
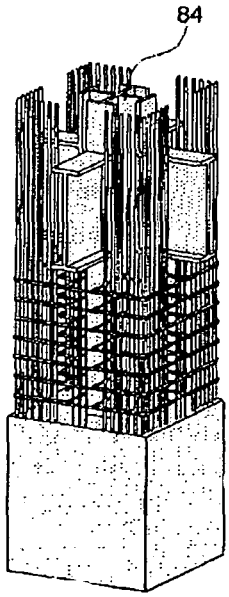

As shown in FIGS. 9A through 9F, the LC frame method involves casting concrete to a height slightly lower than lower ends of the steel beams of the reinforced concrete column, placing and fixing beam pieces rigidly connected to have +-shapes at predetermined positions, and performing a subsequent process. FIGS. 10A and 10B illustrate general steel reinforced concrete columns to which the LC frame method of FIGS. 9A through 9F may be applied. FIG. 10A is a steel reinforced concrete column using H-shaped steels 82. FIG. 10B illustrates a steel reinforced concrete column using cross H-shaped steels 84.

The LC frame method is complex and reinforced concrete and steel-frame work requires cooperation during field work. However, each operation is performed by each subcontractor in practice and thus cooperation is is actually not common.

The applicant has studied a method of strengthening a reinforced concrete column in order to maintain the efficiency of the reinforced concrete column, simplified the process, and reduced the amount of field work, and has developed a PRC column in which reinforcement bars of a reinforced concrete column are prefabricated in factory and are carried and constructed like steel frame materials.

A most preferable joint shape in an earthquake-resistant structure is formed such that two beams formed in a horizontal direction and two beams formed in a vertical direction face each other with a column there between and pass through the column with little resistance or interference by the column. However, a steel frame structure or a steel reinforced concrete structure is formed such that beams are forced to be rigidly connected to a column in order for one beam to pass over another beam. Although the LC frame method solves the problem, since the LC frame method is complex in site conditions, the LC frame method is rarely used by manufacturers other than a manufacturer which developed the LC frame method.

An earthquake-resistant joining method of a prefabricated steel reinforced concrete column using angle steels and steel beams for solving the problems will be explained in detail.

Figure 11A:
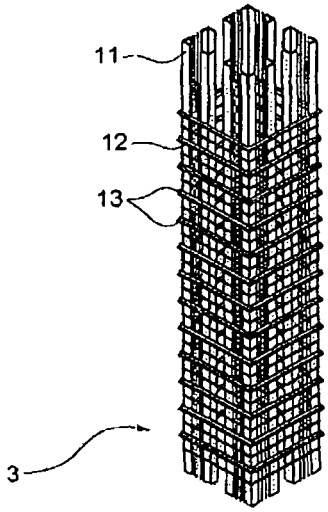
FIGS. 11A through 11E are views that illustrate a method of fabricating a PSRC column, according to an embodiment of the present invention.
Figure 11B:
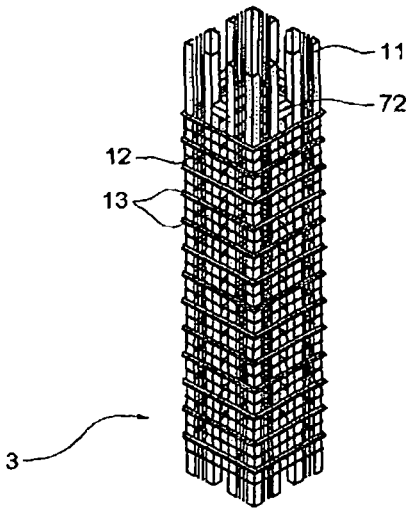
Figure 11C:
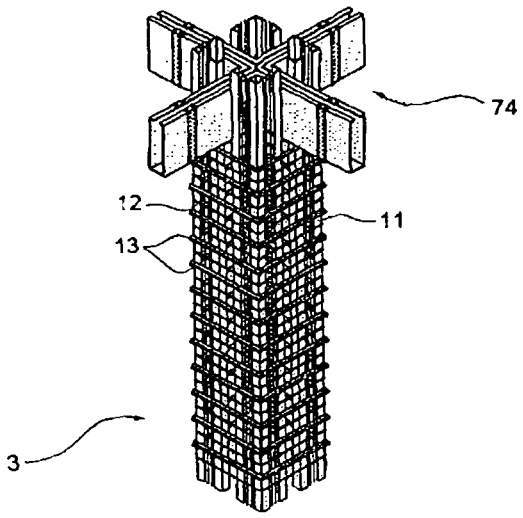
Figure 11D:
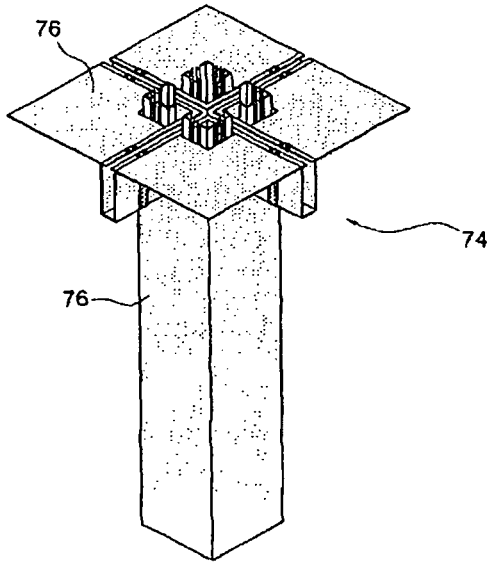
Figure 11E:
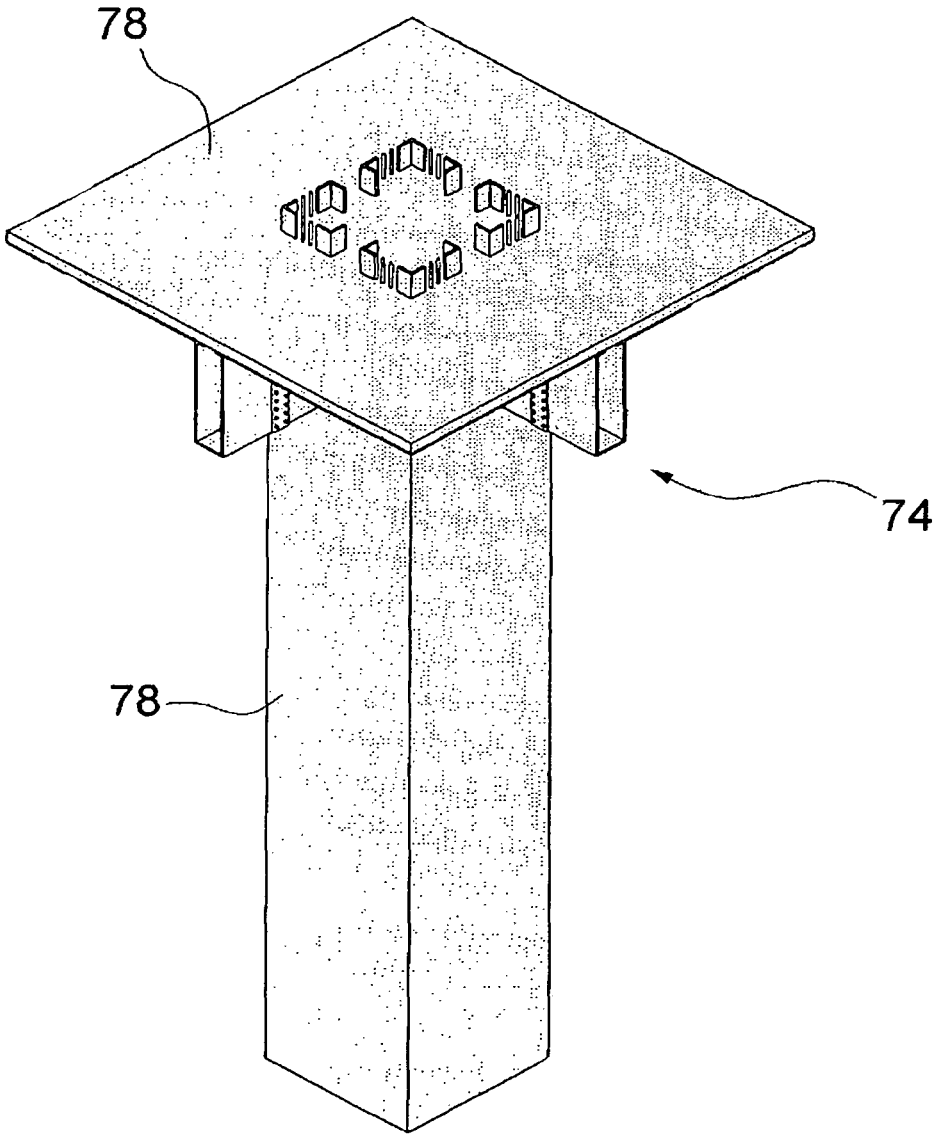

FIGS. 11A through 11E are views for explaining a method of fabricating a PSRC column 3, according to an embodiment of the present invention. In detail, FIG. 11A illustrates the PSRC column 3. FIG. 11B illustrates beam saddles 72 provided on the PSRC column 3. FIG. 11C illustrates +-shaped rigid beams 74 provided on the beam saddle 72. FIG. 11D illustrates a mold 76. FIG. 11E illustrates concrete 78 which is cast.

The PSRC column 3 is formed by distributing steel frame materials positioned at the central to outskirt portions of a steel reinforced concrete column, binding the steel materials with tie bars to form a fabricated column having high strength like a pylon, and replacing steel materials of which cross-sectional areas are slightly changed upward with reinforcement bars. Main materials of the PSRC column 3 are reinforcement bars and angle steels, but if necessary, may be selectively T-shaped steels, Π-shaped steels, or H-shaped steels.

The steel beam earthquake-resistant joining method which involves placing and fixing the + shape rigid beams 74 at a center in a panel zone of the PSRC column 3 horizontally welds the beam saddles 72 between four angle steel pairs 11 which are arranged vertically on left and right sides of 4 beams constituting the +-shaped rigid beams 74 from among the angle steels 11. An interval between the angle steels 11 is greater by 10 to 50 mm than a width of each beam, in order to correct a fabrication error of the PSRC column 3.

Cross-sectional shapes of the beam saddles 72 are ⊓ shapes, T-shapes, or Π-shapes, and top surfaces of the beam saddles 72 are matched to heights of lower ends of lower flanges of the +-shaped rigid beams 74. The lower flanges of the +-shaped rigid beams 74 and the beam saddles 72 are bolted or welded to each other.

When widths of the beams are too large and there is no free space where concrete is poured into the PSRC column 3, column members may be cut and continuously welded to top and bottom surfaces of upper and lower flanges of the beams. In this case, short members such as the cut column members are inserted and welded between the upper and lower flanges of the beams.

Finally, the mold is placed and concrete is cast as in a general steel reinforced concrete column, thereby completing the earthquake-resistant joining method.

The PSRC column 3 from which concrete is removed corresponds to a fabricated steel framed column in which steel frame materials are to distributed to outskirt portions. Hence, since the steel frame materials are spaced apart from one another in all directions by intervals, the +-shaped rigid beams 74 are simply placed between the distributed steel frame materials. Although it is preferable that the distributed steel frame materials (here, the angle steels 11) are vertically arranged to not contact the beams, if there is no free space where concrete is poured into the PSRC column 3 because widths of the beams are too large, the steel frame materials may be arranged by being cut between the upper and lower flanges of the beams and welded between surfaces of the upper and lower flanges of the beams.

According to the earthquake-resistant joining method of the steel beams and the PSRC column 3, section design efficiency may be maximized by maximally pushing the steel frame materials of a steel reinforced concrete structure to outskirt portions. Also, in the steel reinforced concrete structure or a steel frame structure, the PSRC column 3 and the beams may be continuously joined to each other and the amount of welding and the number of bolts may be minimized. This is because in a general earthquake-resistant joining method, costs and efforts for controlling a defective rate are high in addition to a long construction period and high construction costs.

A desired earthquake-resistance joining method is a method in which steel materials of X-Y direction beams pass through a column in a panel zone without physically colliding with each other. The earthquake-resistant joining method of the present embodiment is close to the desired earthquake-resistant joining method.

Also, because there is no steel material at the center of the PSRC column 3, the PSRC column 3 may be economically designed and an earthquake-resistant joining method may be easily performed by placing the +-shaped rigid beams 74 on the beam saddles 72 attached to the PSRC column 3 like in a wooden structure and performing a subsequent process with a minimum number of bolts and a minimum amount of welding.

Since the steel materials are disposed at outskirt portions of the PSRC column 3, a pure span of each of the beams joined to the steel materials is reduced advantageously. Since a maximum bending moment is proportional to the square of a span, when the pure span of each of the beams is reduced, a designed section is also reduced.

The PSRC column 3 has higher bending resistance against a vertical load and higher earthquake resistance than a general steel reinforced concrete column.

Figure 12A:
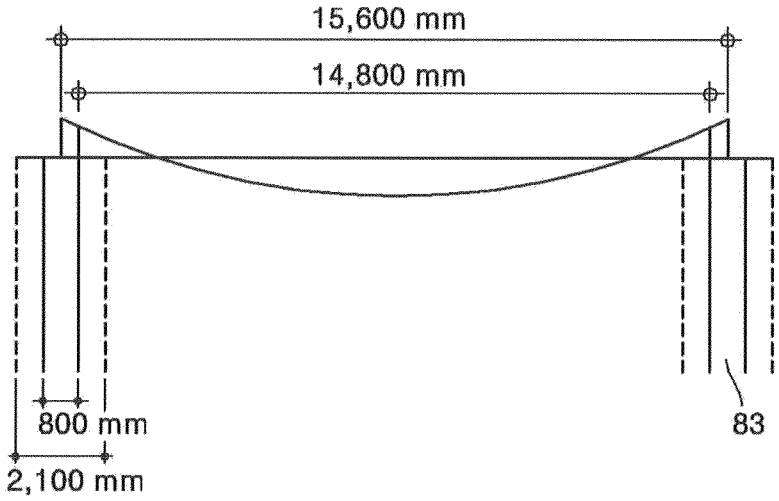
FIGS. 12A and 12B are views that illustrate a relationship between a bending moment and a pure span in the PSRC column and a general steel reinforced concrete column.
Figure 12B:
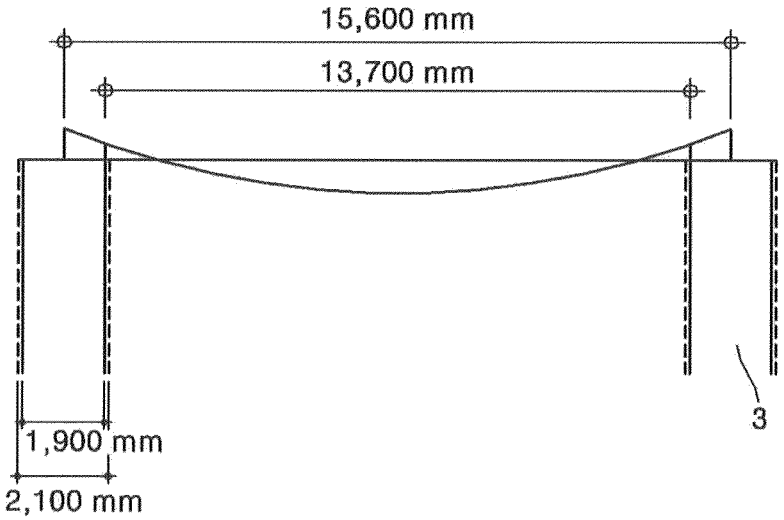

FIGS. 12A and 12B are views for explaining a relationship between a bending moment and a pure span in the PSRC column 3 and a general steel reinforced concrete column. In detail, FIG. 12A illustrates a bending moment of the general steel reinforced concrete column of FIG. 10B using the cross H-shaped steels 84. FIG. 12B illustrates a bending moment of the PSRC column 3.

That is, FIG. 12B illustrates a bending moment and a pure span of the PSRC column 3 having a concrete covering depth of 1,900×1,900 mm instead of the general steel reinforced concrete column having a center width of 15.6 m, an outskirt size of 2.1×2.1 m, and a cross H-shaped steel size of 800×800 mm.

According to calculation results, a bending moment applied to the PSRC column 3 is 85.7% of a bending moment applied to the general steel reinforced concrete column using the cross H-shaped steels 84. The results are obtained by the following equation based on the fact that a bending moment of a beam to which uniformly distributed loads are applied is proportional to the square of a span.

$$(15.6-1.9)^2/(15.6-0.8)^2=0.857$$

Figure 13A:
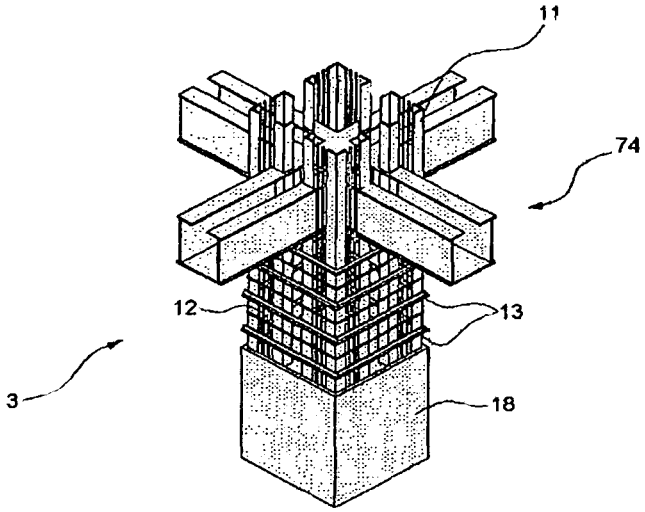
FIGS. 13A and 13B illustrate steel materials of a column arranged when there is little space where column concrete is to be cast because a cross-sectional area of the column is small and widths of +-shaped rigid beams are large.
Figure 13B:
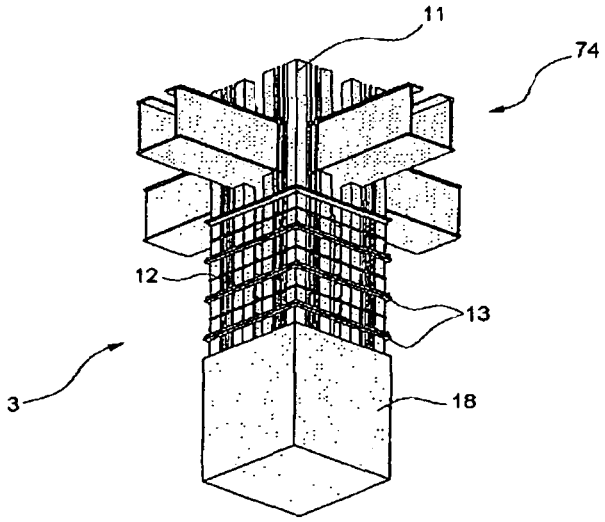

The PSRC column 3 may vary in shape. For example, when a cross-sectional area of the PSRC column 3 is small, widths of the +-shaped rigid beams 74 are large, and thus, there is little space where concrete is to be cast, steel materials of the PSRC column 3 may be arranged like in a PSRC column 3' shown in FIGS. 13A and 13B.

Figure 14A:
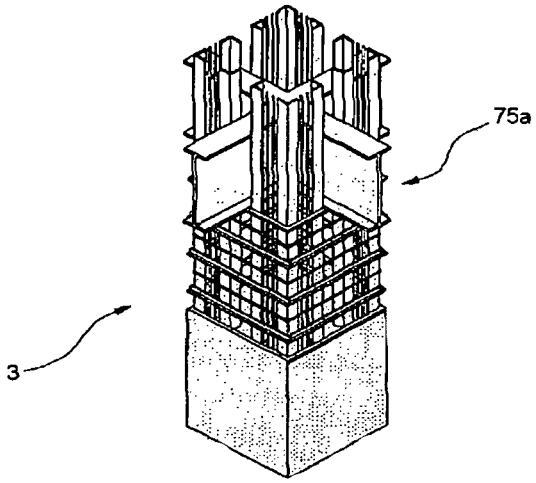
FIGS. 14A and 14B illustrate a PSRC column using +-shaped rigid beams including H-shaped steels and a PSRC column using +-shaped rigid beams including "TSC (The SEN Composite beam)" composite beams.
Figure 14B:
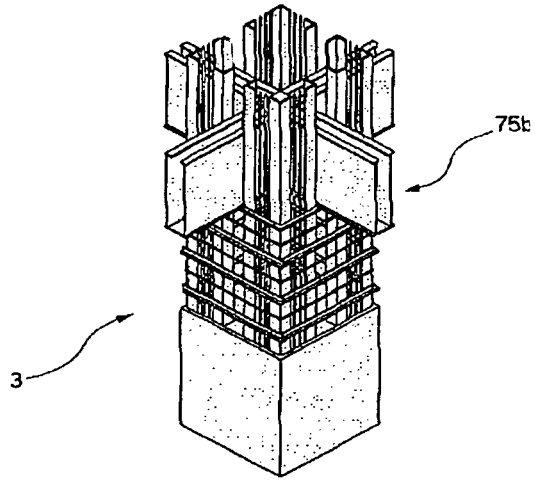

Also, +-shaped rigid beams of the PSRC column 3' may include H-shaped steels or TSC (The SEN Composite beam) composite beams. That is, the +-shaped rigid beams may include H-shaped steels, as shown in FIG. 14A, and the +-shaped rigid beam may include TSC composite beams, as shown in FIG. 14B.

Next, a gang forming method of a PSRC column according to an embodiment of the present invention will be explained.

A steel reinforced concrete column is formed by adding steel frame materials such as H-shaped steels or cross-H-shaped steels to a center of the steel reinforced concrete column. Although the steel frame materials at the center may be self-supported, it is impossible to simplify a mold by supporting the mold with the steel frame materials. This is because reinforcement bars which may not be self-supported are distributed between the mold and the steel frame materials disposed at the center, and thus, the mold may not be directly supported by the steel frame materials at the center. Hence, like a reinforced concrete column, the steel reinforced concrete column is generally provided such that the mold maintains verticality by itself as lateral pressure of concrete is applied to the mold.

A PSRC column which is subjected to the gang forming method of the present embodiment exhibits strength and resistance high enough to support a construction load transmitted from bottom plates and beams attached to the PSRC column as well as its weight prior to concrete casting by distributing reinforcement bars and angle steels at outskirt portions of the PSRC column and preventing steel frame materials of a general steel reinforced concrete column from being disposed at a center of the PSRC column. Since steel materials are distributed to the outskirt portions of the PSRC column, a mold may have higher quality and lower costs than a general self-supported mold by being supported by the PSRC column.

As a length of a column increases, it is very difficult to surround the column with a mold at one time irrespective of whether the mold may be self-supported. In particular, since mega columns of multistory buildings, factories using large capacity cranes, or special production facilities having a height of 20 m or more, it takes a long time and high cost to manufacture, fabricate, and dismantle a mold.

When a reinforced concrete structure having the same cross-sectional shape and size and a great length such as a silo, a chimney, a control tower, or a pier of a bridge is constructed, a method of pushing upward and reusing a mold having a certain height instead of a method of attaching a mold over the entire reinforced concrete structure at one time may be implemented. The method is referred to as a sliding forming method or a slip forming method. Also, for left and right walls of a wall-type apartment having a smooth vertical surface without projections from a lowermost story to an uppermost story, a mold used for the lowermost story is pushed upward and reused for every story, which is referred to as a gang forming method, instead of being manufactured for every story.

A gang forming method involves pushing upward and reusing a large plate-shaped mold by using a crane without dismantling the mold. A sliding forming method involves pushing upward a mold by inserting a plurality of steel rods into lower concrete and inserting hollow climbing hydraulic jacks into the steel rods. The forming method has an advantage in that a working platform on which a worker can stand and a mold are integrally manufactured and materials such as reinforcement bars may be carried, fabricated, and concrete may be cast on the mold and the working platform which are integrally formed. The mold may be continuously gradually pushed up. The forming method has some problems mainly because the mold is pushed upward. The steel rods need to have sufficient strength considering the risk of buckling. In particular, when the steel rods are formed such that female and male screws have minimum thicknesses to upwardly extend the steel rods and the steel rods have minimum thicknesses not to be buckled due to a compressive force, costs of the steel rods are very high. In addition, the expensive steel rods are thrown away after they are used once. A control device for operating the plurality of hydraulic jacks at the same speed may be used.

In order to remove the mold for a column, an early strength concrete compressive strength needs to be 5 Mpa or more, and about 8 hours after casting needs to pass. For the 8 hours, lateral pressure applied to the mold is proportional to an increment in a length of the column. Since the bending stress of mold plates, joists, or yokes is proportional to the square of the length, a weight and a size of the mold are greater than those of steel reinforcement bars of the column as the length of the column increases.

The effect of a PSRC column increases as a length of a column increases due to structural characteristics. However, when a general mold is used and a length of a PSRC column exceeds a predetermined value, the general mold is heavier and larger than steel reinforcement bars of the PSRC column, and the capacity and number of lifting equipment used on-site are inefficiently increased due to the weight of the general mold and not due to the PSRC column. Also, when a mold manufactured and dismantled on-site is too heavy and complex, an advantage of a PSRC column that a total construction period is reduced and a field work is minimized by prefabricating column steel reinforcement bars in factory may be partially lost.

Accordingly, an object of the gang forming method of the present embodiment is to reduce construction costs and improve resource utilization by solving problems that may arise when expensive steel rods are used only once and it is difficult to control a hydraulic pump.

Also, when a gang forming method or a sliding forming method is applied to a column which may be self-supported before concrete casting like a PSRC column, an object of the gang forming method is to replace steel rods, which are thrown away after being used once, with inexpensive and reusable products (here, steel strands) and use inexpensive general products which may easily control a device such as a hydraulic pump or a control device.

Also, a method of fabricating and dismantling yokes, which support lateral pressure of concrete, of a mold for a column is complex and the mold is dismantled by being impacted or forcedly widened with a lever by using a device for separating the mold and the concrete overcoming an adhesive force between the mold and the concrete. Accordingly, an object is to provide a method of separating a mold and concrete more simply and effectively.

Although lateral pressure of concrete applied to a lower portion of a mold increases as a height of the concrete cast at one time increases, this is disregarded when the mold is designed and an entire height of a column is fixed in practice. An object is to provide a method of minimizing the waste of mold materials by designing the mold to have only necessary resistance according to a difference in lateral pressure between upper and lower portions of the mold.

A gang forming method of a PSRC column for achieving the objects will now be explained in detail with reference to the attached drawings.

Figure 15A:
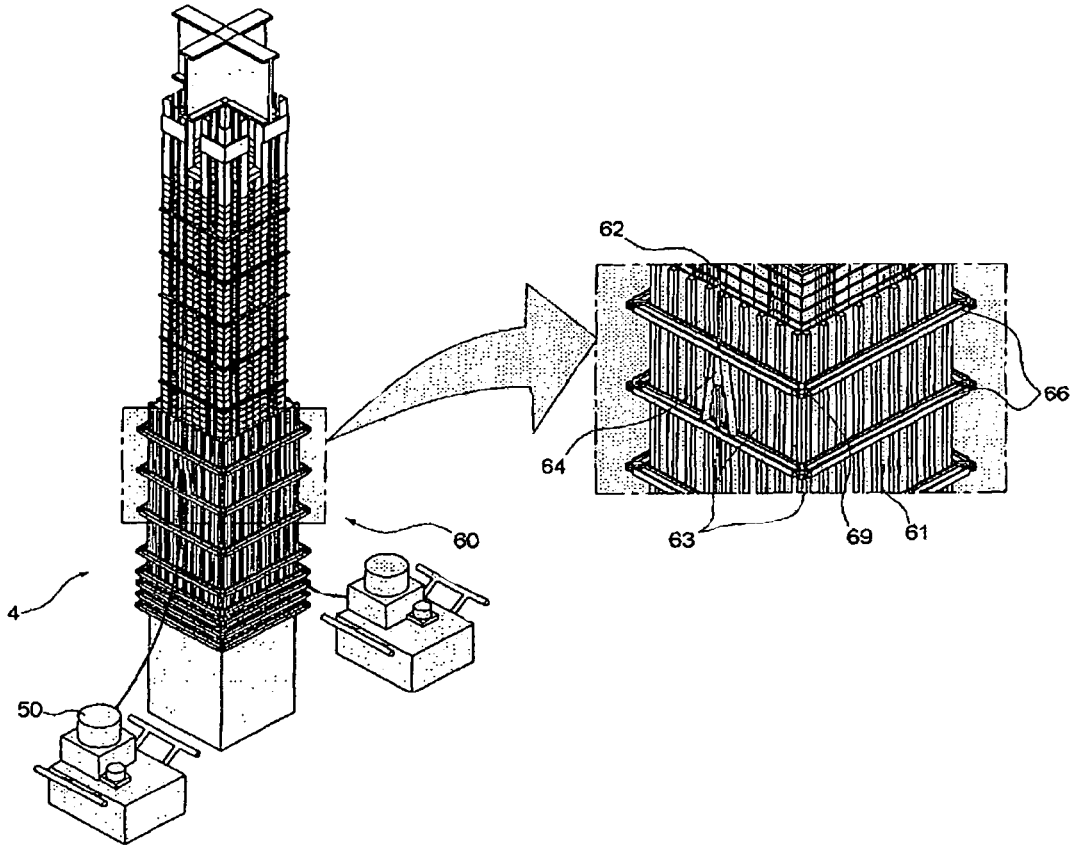
FIG. 15A illustrates a mold coupled to a PSRC column.
Figure 15B:
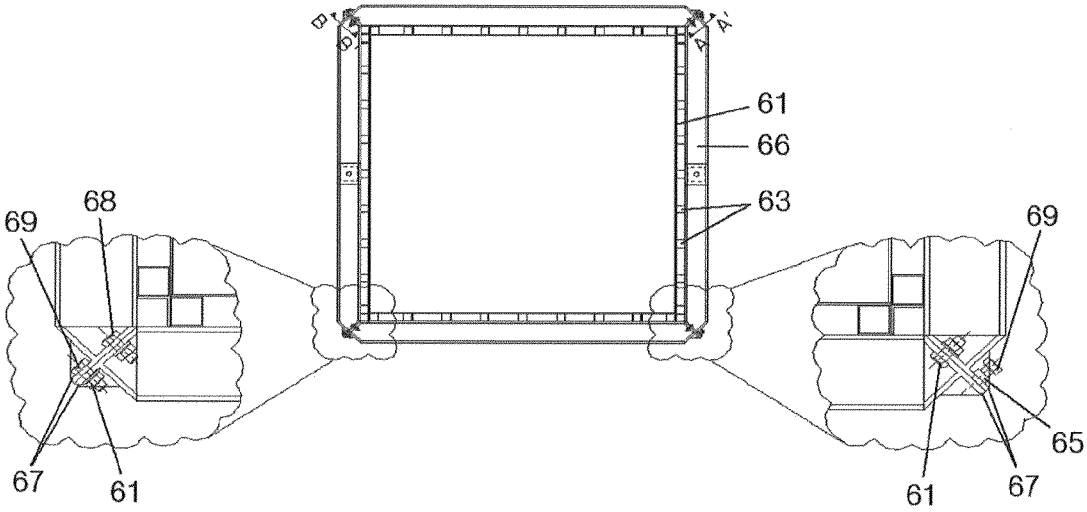
FIG. 15B is a cross-sectional view illustrating the mold of FIG. 15A.
Figure 15C:
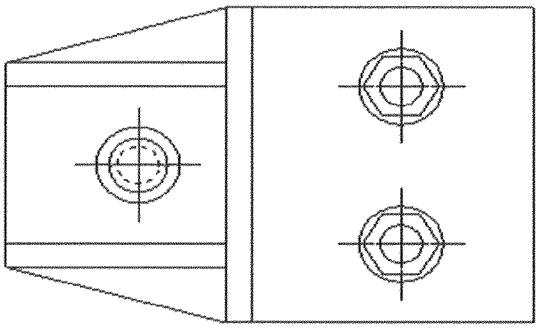
FIG. 15C is a cross-sectional view taken along line A-A of FIG. 15B.
Figure 15D:
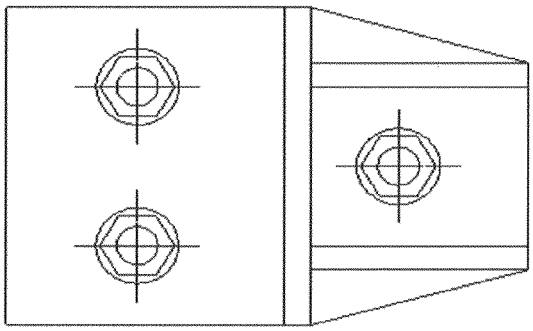
FIG. 15D is a cross-sectional view taken along line B-B of FIG. 15B.

FIG. 15A illustrates a case where hollow climbing hydraulic jacks 64 are fabricated by using a jig at centers of yokes 66 corresponding to a mold 60, steel strands 62 hanging from the girders 41 or brackets of an upper end of a PSRC column 4 pass through the hydraulic jacks 64, and the mold 60 is moved upward by using hydraulic pumps 50. FIG. 15B is a cross-sectional view illustrating the mold 60 of FIG. 15A. FIG. 15C is a cross-sectional view taken along line A-A of FIG. 15B. FIG. 15D is a cross-sectional view taken along line B-B of FIG. 15B.

The gang forming method of the present embodiment pushes the mold 60 upward from an upper end, unlike a conventional sliding forming method which pushes upward a mold, because the PSRC column 4 may be self-supported prior to concrete casting. The conventional sliding forming method uses expensive thick steel rods because in order to push the mold upward, members acting as rails which hydraulic jacks hold and move upward need to be self-supported and weights of the mold and the hydraulic jacks, that is, a considerable compressive force, need to be borne.

The gang forming method of the present embodiment uses the steel strands 62 which are extended and less expensive than steel rods in order to push the mold 60 upward. The steel strands 62 are 7 steel strands having a diameter of 12.7 mm and a long-term tensile resistance of 10 tf which are widely used in basement sheathing works. The hollow climbing hydraulic jacks 64 having the same standard as that used to pre-stress the steel strands 62 in the basement sheathing works are used. The hydraulic jacks 64 are fixed to the mold 60 by a jig.

An object of the gang forming method of the present embodiment is to fabricate and dismantle the yokes 66 more quickly and more simply than a typical sliding forming method by using tensile and compressive stress. Also, since lateral pressure of concrete applied to a mold plate 61 varies according to a height of the mold 60, an object of the gang forming method is to adjust lengths of joists 63 by adjusting an interval between the yokes 66 and more efficiently use the joists 63 and the yokes 66.

The steel strands 62 are hung from two corresponding places of the steel girders 41 or the brackets at the upper end of the PSRC column 4 which is self-supported before concrete casting and curing, and lower ends of the steel strands 62 are coupled to the hollow climbing hydraulic jacks 64.

Next, the hydraulic jacks 64 are attached to centers of the yokes 66 by a jig. The mold 60 is moved upward by operating the hydraulic pumps 50 by connecting a hydraulic hose between the hydraulic pumps 50 and the two hydraulic jacks 64.

The yokes 66 are disposed around the mold 60. The effect of the joists 63 and the yokes 66 may be improved by making an interval between the yokes 66 at a lower portion of the mold 60, where lateral pressure of concrete is high, lower than an interval between the yokes at an upper portion of the mold 60 where lateral pressure of concrete is low.

The mold 60 is manufactured to have a height which is ½ to ¼ of a height of the PSRC column 4 and concrete is cast in steps. Curing is performed until a compressive strength of the concrete reaches 5 Mpa, the mold 60 is moved upward, and the concrete is cast.

In order to smoothly move the mold 60 upward, joint bolts 68 attached to the yokes 66 at two places from among 4 corners of the mold 60 are unfastened halfway and separation bolts 69 are fastened clockwise to separate the mold 60 from a surface of the concrete, thereby making it easier for the mold 60 to move upward.

When the mold 60 is moved upward to reach a predetermined position, the separation bolts 69 are returned to original states, and the joint bolts 68 are fastened again, thereby completing preparation for subsequent concrete casting.

When the mold 60 reaches a highest height of the PSRC column 4 and concrete casting and curing end, the mold 60 is separated from the surface of the concrete as described above, placed on the ground by using a crane, dismantled, and moved to a next position of the PSRC column 4, and the aforesaid series of operations are repeatedly performed.

When an interval between the yokes 66 at a lower portion of the mold 60 where lateral pressure of concrete is high is lower than an interval between the yokes 66 at an upper portion of the mold 60 where lateral pressure of concrete is low, lengths of the joists 63 are automatically reduced, thereby improving the effect of the joists 63 and the yokes 66.

In order to fabricate two yokes 66 having H-shapes and meeting each other at a right angle, three bolt holes including two outskirt bolt holes and one central bolt hole are formed in an end portion of one yoke 66, two outskirt bolt holes are formed in an end portion of the remaining yoke 66, the end portions are reinforced with stiffeners 672 to obtain joint steel plates 67, and the joint steel plates 67 are welded to the end portions of the yokes 66 at 45°.

The joint bolts 68 are inserted into the outskirt bolt holes of the bolt holes of the joint steel plates 67 that face each other, and a coupler 65 is welded to an outer surface of the central bolt hole.

Figure 16A:
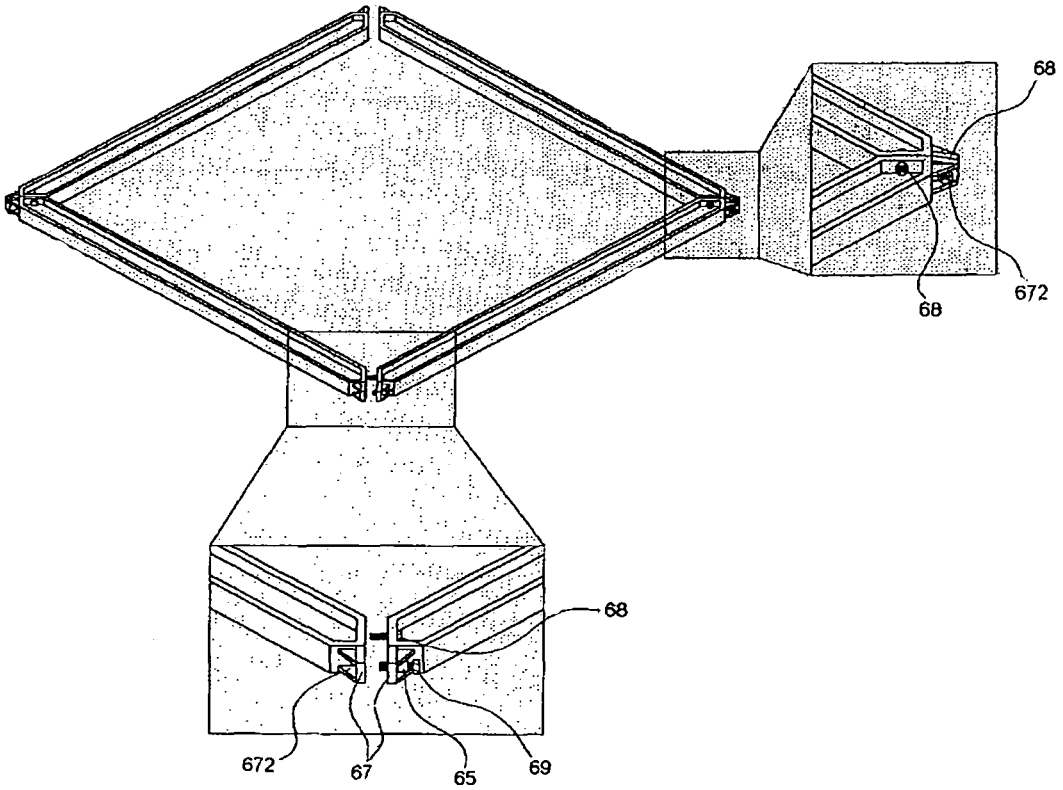
FIGS. 16A and 16B illustrate a method of separating a form.
Figure 16B:
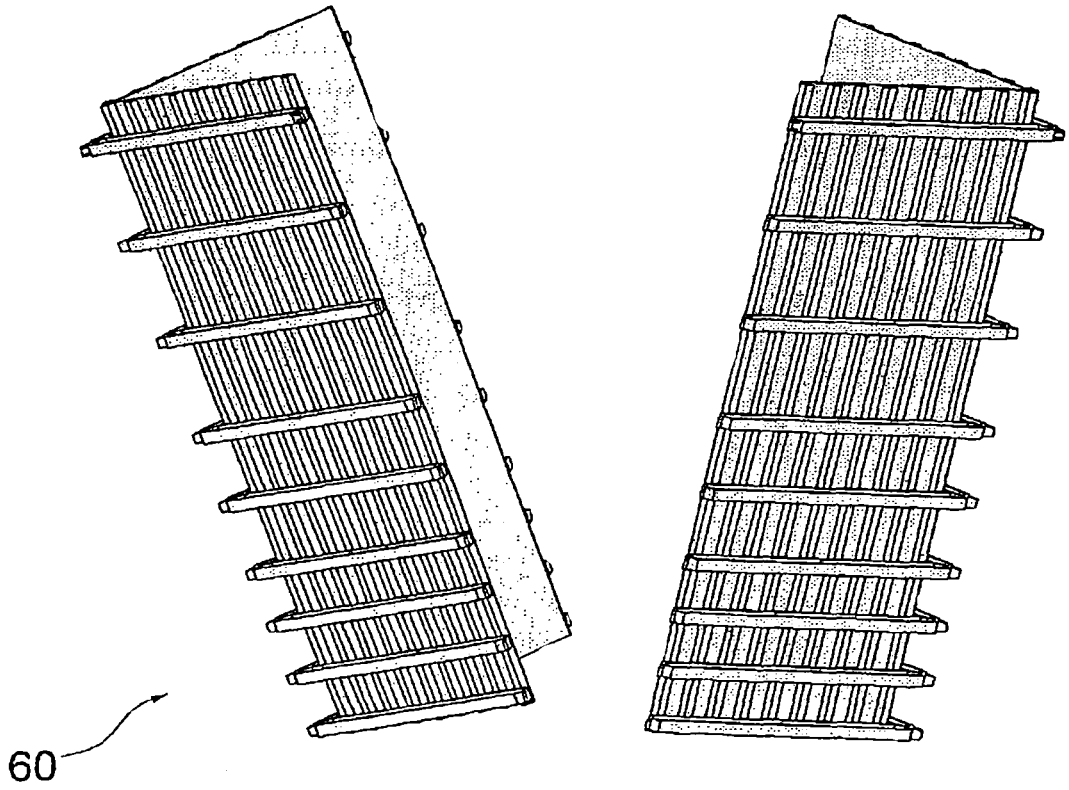

In order to dismantle the end portions of the yokes 66 and separate the mold 60 from the concrete, the joint bolts 68 are unfastened, the separation bolts 69 inserted into the coupler 65 are turned clockwise such that the separation bolts 69 push surfaces of the joint steel plates 67 with no bolt hole to form a force for widening an interval between the joint steel plates 67, the joists 63 rigidly connected to the yokes 66 facing each other, and the mold 60 is separated from a surface of the concrete when the force exceeds an adhesive force between the concrete and the mold 60. FIGS. 16A and 16B illustrate a case where the mold 60 is separated by unfastening the yokes 66.

Figure 17:
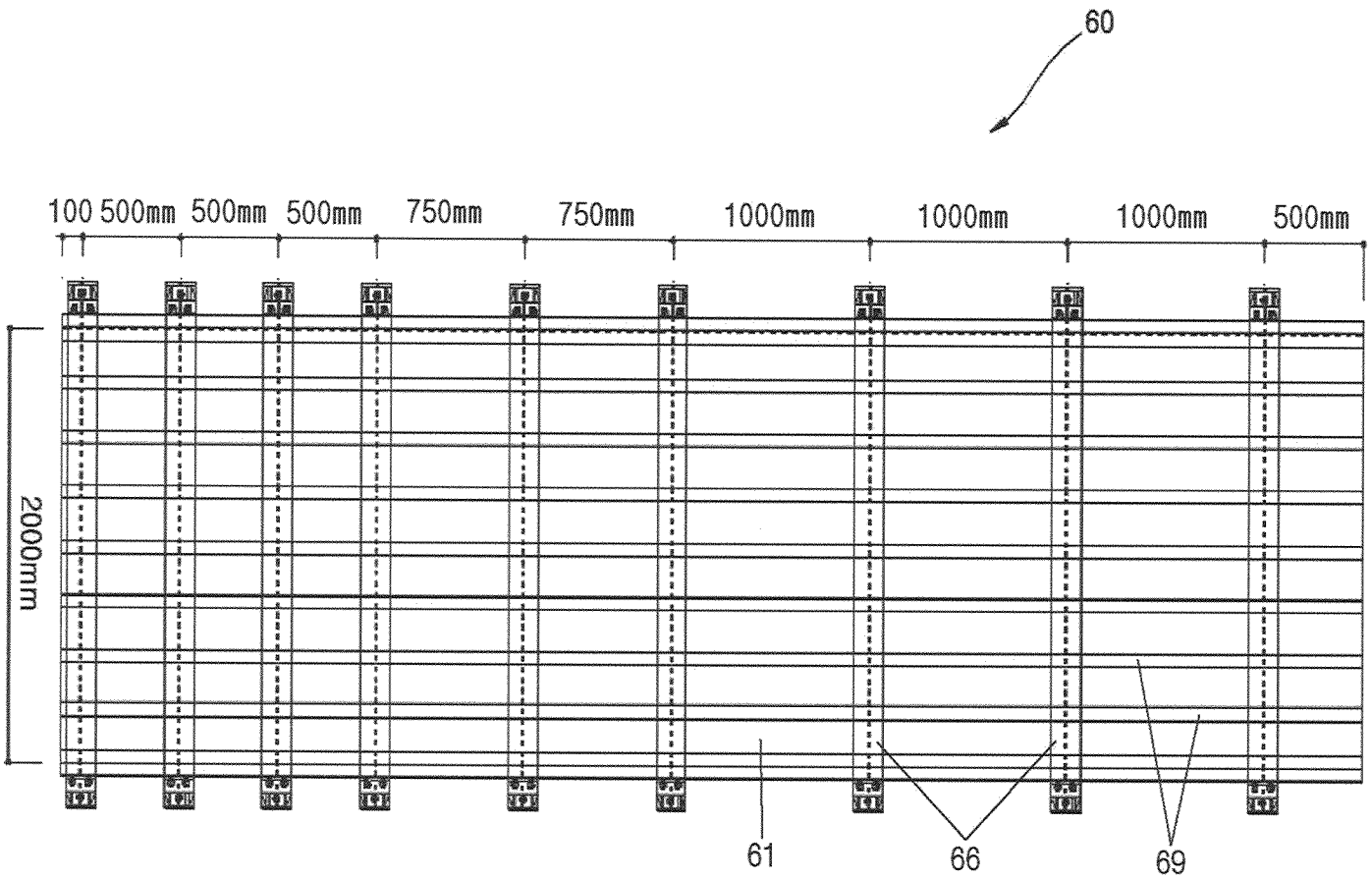
FIG. 17 illustrates a case where an interval between yokes and lengths of joists vary according to a height of a mold.

As such, according to the gang forming method of the present embodiment, the yokes 66 may be simply attached and detached. Also, the problem of adhesive resistance generated between the concrete and the mold 60 may be easily solved. Also, since the mold 60 is designed according to lateral pressure of concrete which is different in upper and lower portions of the mold 60, the verticality of the mold 60 may be effectively maintained irrespective of the lateral pressure of concrete. FIG. 17 illustrates a case where lengths of the joists 63 and an interval between the yokes 66 vary according to a height of the mold 60. Since the yokes 66 are more densely disposed at a lower portion of the mold 60, the mold 60 may effectively bear lateral pressure of concrete.

Considering the fact that a formwork is about ⅓ in terms of construction costs and a construction period of reinforced concrete or steel reinforced concrete, the gang forming method of the present embodiment may effectively reduce overall construction costs and construction period by simplifying the formwork.

The gang forming method of the present embodiment may reduce mold-related construction costs by simply manufacturing a mold to have a height which is ½ to ¼ of a height of a column having the same cross-sectional shape and a great length, pushing upward the mold in steps, and performing concrete casting 2 to 4 times.

According to the Standard Specification for Concrete, in order to prevent quality degradation due to the accumulation of shrinkage, a column having a height of 3 to 4 m or more shall not be cast at one time. However, in order to meet a deadline, a column having a height of 10 m or more is casted at one time when a manager does not pay attention.

Since the gang forming method of the present embodiment manufactures a mold to have a height which is ⅓ to ¼ of a height of a column and casts concrete separately in steps, such wrongful practices may be prevented.

Since steel fabrication shops have not been good at processing and fabricating reinforcement bars, they find it difficult to manufacture a PRC column which requires reinforcement bars to be processed and fabricated. Accordingly, only some makers produce limited quantities. However, if a PRC column is changed to a PSRC column which uses angle steels instead of reinforcement bars, since any steel fabrication shop may easily produce the PSRC column, the PSRC column may be widely used in a short time. However, since angle steels are lighter than H-shaped steels, costs are added per weight. Since domestic steel fabrication shops generally obtain orders based on costs per ton, the domestic steel fabrication shops don't like to use lighter steel materials. However, since a rise in costs per ton already occurs when the PRC column is produced, the burden of additional costs does not seem to occur. The PSRC column using angle steels is economically better by about 25 to 35% than the PRC column and has higher manufacturing precision than that of the PRC column.

The PRC column has a disadvantage in that joint plates are added to joints between upper and lower portions of the PRC column. However, the PSRC column does not require such joint plates. If a mold for a panel zone of the PSRC column having a vertical error is manufactured to correct the error, a field work of a carpenter for the mold may be drastically reduced, thereby greatly reducing a construction period.

While the present invention has been particularly shown and described with reference to exemplary embodiments thereof, it will be understood by those of ordinary skill in the art that various changes in form and details may be made therein without departing from the spirit and scope of the present invention as defined by the following claims.

I claim:

1. A method of constructing a prefabricated steel reinforced concrete (PSRC) column having angle steels and reinforcement bars, the method comprising:

erecting angle steels on corners of a PSRC column having a quadrangular cross-sectional shape;

providing auxiliary reinforcement bars between the angle steels;

surrounding the angle steels and auxiliary reinforcement bars with tie bars horizontally arranged at intervals;

welding the tie bars around the auxiliary reinforcement bars and the angle steels;

welding column capital steel plates outside the angle steels and the auxiliary reinforcement bars steel plates being corresponding to height of a beam or a bracket which is attached to the column capital steel plates; and diagonally attaching column capital reinforcing steel plates inside the PSRC column.

2. The method of claim 1 further comprising attaching beams or brackets outside the column capital steel plates.

3. The method of claim 2, further comprising:

forming bolt holes for attaching short angle steels whose height is corresponding to the height of the beams or brackets to side surfaces of the beams or brackets, which are spaced by a distance corresponding to a concrete covering depth, in end portions of the beams or brackets attached to the PSRC column;

attaching the short angle steels to the side surfaces of the beams or brackets with bolts; and fixing end portions of angle lightweight pre-formed steel plates to the short angle steels with self-drilling screws.

4. The method of claim 1 further comprising:

transporting the PSRC column to an on-site location;

erecting the PSRC column on-site;

providing a mold around the PSRC column; and casting concrete into the mold.

5. The method of claim 1 further comprising:

fixing +-shaped rigid beams at a center of the PSRC column in a panel zone of the PSRC column;

horizontally welding beam saddles between angle steel pairs arranged with a free space of 10 mm or more, which is larger than the widths of each beam, at left and right sides of each +-shaped rigid beam;

forming cross-sectional shapes of the beam saddles to be one of a -shape, a T-shape, or a Π-shape;

forming top surfaces of the beam saddles to match a height of a lower end of lower flange of the +-shaped rigid beams;

joining the PSRC column to the beams by securing the beam saddles to lower flanges of the +-shaped rigid beams; and providing a mold around the PSRC column and casting concrete into the mold.

6. The method of claim 5 further comprising:

cutting and continuously welding cut column members to top and bottom surfaces of upper and lower flanges of the beams.

* * * * *